US008588450B2

(12) United States Patent
Donarski

(10) Patent No.: US 8,588,450 B2
(45) Date of Patent: Nov. 19, 2013

(54) ANNULAR RING ACOUSTIC TRANSFORMER

(75) Inventor: Matthew A Donarski, Minneapolis, MN (US)

(73) Assignee: Robert Bosch GmbH, Stuttgart (DE)

( * ) Notice: Subject to any disclaimer, the term of this patent is extended or adjusted under 35 U.S.C. 154(b) by 401 days.

(21) Appl. No.: 12/849,989

(22) Filed: Aug. 4, 2010

(65) Prior Publication Data

US 2012/0033841 A1 Feb. 9, 2012

(51) Int. Cl.
*H04R 1/20* (2006.01)

(52) U.S. Cl.
USPC ..... 381/340; 381/342; 381/351; 381/357

(58) Field of Classification Search
USPC ..... 381/337–344; 181/175, 177–179, 192, 181/199
See application file for complete search history.

(56) References Cited

U.S. PATENT DOCUMENTS 1,744,101 A 1/1930 Brandstrom
2,127,110 A * 8/1938 Farrand ..... 381/342
5,606,297 A 2/1997 Phillips
6,028,947 A * 2/2000 Faraone et al. ..... 381/340
2007/0080019 A1 4/2007 Kubota
2007/0195647 A1 8/2007 Butler et al.
2008/0264717 A1 10/2008 Onishi

FOREIGN PATENT DOCUMENTS

FR 602427 A 3/1926

* cited by examiner

*Primary Examiner* — Davetta W Goins
*Assistant Examiner* — Amir Etesam
(74) *Attorney, Agent, or Firm* — Keith Swedo; Taft, Stettinius & Hollister LLP

(57) ABSTRACT

An acoustic transformer includes at least one outer boundary wall. A plurality of inner walls are disposed within the outer boundary wall. The outer boundary wall and the inner walls define an input opening divided by at least some of the inner walls into a plurality of input sections. A substantially annular output opening is divided by at least some of the inner walls into a plurality of circumferentially-spaced output sections. Each of the output sections has an inner circumferential side and an outer circumferential side. Each of a plurality of acoustic paths interconnects a respective one of the input sections with a respective one of the output sections. Each of the paths has a substantially equal path length and a substantially equal expansion rate.

22 Claims, 42 Drawing Sheets

1100

310

ANNULAR RING ACOUSTIC TRANSFORMER

BACKGROUND OF THE INVENTION

1. Field of the Invention

The present invention relates to audio speaker systems, and, more particularly, to audio speaker systems including acoustic transformers that transform wavefronts of one shape from primary waveguides into another shape for input into sound disseminating secondary waveguides.

2. Description of the Related Art

Typically, a horn-type loudspeaker consists of a driver coupled to an initial throat section. The geometry of the sound-radiating diaphragm of the loudspeaker driver may be a cone, a spherical dome, a flat piston, or an annular ring-radiating diaphragm.

It is well known that the angle of sound radiation of the loudspeaker driver is dependent on the dimensions of the radiating exit relative to the wavelength of sound that is being generated. When the wavelength of sound is large compared to the dimension of the driver exit, the resulting radiation pattern has a wide angle. When the wavelength of sound is small compared to the dimension of the driver exit, the resulting radiation pattern has a narrow angle.

The walls of a horn can only confine the radiation pattern; the walls cannot widen the pattern. If the pattern of sound radiated from driver is wider than the angle of the horn walls, then the sound from the driver will fill the horn and the horn walls will determine the resulting radiation pattern of the horn/driver combination.

On the other hand, if the pattern of sound radiated from driver is narrower that the horn walls, then the sound from the driver will radiate as a narrow beam through the horn and the resulting radiation pattern of the horn/driver combination will be substantially unaffected by the horn walls. In this latter case, where the angle of radiation from the driver exit is narrower than the desired coverage, several techniques have been used in the prior art.

One technique in the prior art to widen the angle of radiation of the driver exit is to pass the sound from the driver exit through an acoustic-transformer/geometry-transition that changes the shape from a round to a rectangular slot, wherein one dimension of the slot is smaller than that of the driver exit. If the smallest dimension of the rectangular slot is smaller than the wavelength of sound, then the radiation angle from the slot will be wide and the horn walls can control the angle of radiation from the horn/driver combination (see U.S. Pat. Nos. 4,187,926 and 4,308,932).

The transformation from round to rectangular can solve the problem in the direction where the slot is smaller than the driver exit. However, problems may still exist in the direction where the direction where the rectangular slot dimension is larger than the driver exit.

Another technique used in the prior art in addition to the rectangular slot is to apply vanes in the throat that spread out the acoustic energy, widening the radiation angle (see U.S. Pat. No. 4,685,532). The vanes are a brute force approach to spreading the pattern out.

In the former case, where the angle of radiation from the driver exit is wider than the desired coverage, the horn walls can control the angle of radiation from the horn/driver combination. However, for very narrow horn/driver radiation angles, the horn can become long enough to create practical problems. Several techniques have been used in the prior art to narrow the coverage angle in a shorter distance. These effectively use an acoustic-transformer/geometry-transition that transforms from the round driver exit to a rectangular slot wherein the wave front has been tailored to be substantially flat, resulting in a narrow radiation pattern. This may be substituted for the first part of the horn, shortening the overall length. These inventions use path way geometries to delay the arrival of the sound at the center of the rectangular slot, making the wave front at the rectangular slot substantially flat (see U.S. Pat. Nos. 5,163,167, 6,581,719 and 6,668,969).

The above describes horn/driver combinations with symmetric radiation angles. However, a horn may be designed to radiate sound energy asymmetrically, directing more energy out the top of the horn and less energy out the bottom. One technique in the prior art to achieve that is to pass the sound from the driver exit through an acoustic-transformer/geometry-transition that changes the shape from round to a tall slot with a semi-trapezoidal shape that is wider at the top than at the bottom. This geometric transition directs more energy towards the top. The trapezoidal-shaped slot is coupled to horn flares to define the radiation angles of the horn/driver combination. (see U.S. Pat. No. 5,020,630).

For substantially curved and substantially flat wavefronts, the prior art addresses the two extremes as independent devices—devices that are applicable for making the radiation pattern from the loudspeaker driver exit much wider, or devices for making the pattern much narrower. The prior art addresses asymmetrical energy distribution with slots of varying widths.

The propagation of sound in a horn may be described by the one-dimensional horn equation:

$$\frac{\partial^2 \phi}{\partial t^2} - c^2 \frac{\partial \phi}{\partial x} \frac{\partial}{\partial x}(\log S) - c^2 \frac{\partial^2 \phi}{\partial x^2} = 0$$

where the scalar velocity potential, $\phi$, is described along the x direction, and the cross sectional area of the horn is given by S. The speed of sound c (e.g., the speed of pressure waves) may be defined by:

$$c^2 = B/\rho$$

where B is the bulk modulus of a gas (such as air), and $\rho$ is the fluid density of the gas. The acoustic impedance at the throat of a waveguide is determined by the size and shape of the input and output of the device, the expansion function S and the waveguide length. This is a one-dimensional approximation for determining the radiation impedance of an acoustic waveguide. So, for two acoustic paths to have equal impedance they must share the same input and output shape, length, and expansion function.

According to the prior art, when designing waveguides for the purpose of transforming the apparent shape of the source, certain assumptions are made regarding the nature of the source. U.S. Pat. No. 5,163,167, for example, assumes a planar circular isophase wave surface as the excitation for such a waveguide. The term "isophase" means that the sound wave produced would be similar to the sound wave produced by a single piston-like vibrating disk. It can be shown for all electromechanical transducers that there exists a high frequency limit where diaphragm mode shapes and/or acoustic effects produce a non-planar, non-isophase wave front.

What is neither disclosed nor suggested in the art is an acoustic waveguide that does not have the problems and limitations of prior art waveguides as described above.

SUMMARY OF THE INVENTION

The present invention addresses the acoustic-transformer/geometry-transition portion in the initial section of a horn.

The present invention may utilize a technique that enables the angle of radiation from a loudspeaker driver exit to be tailored to be wider, narrower or any angle in-between. The present invention may use unique sound paths to precisely define the energy distribution, which may be asymmetrical.

The present invention provides an acoustic waveguide that may transform a planar or nonplanar wave at its entrance into a planar wave with uniform power distribution at its exit. The radial divisions near the entrance may be maintained until the annular ring exit. Each of a plurality of acoustic paths from the radial division to the annular ring output has an equal path length and an equal expansion rate so that the acoustic impedances of all paths from input to output are equal.

A second acoustic waveguide may receive the output of the first waveguide. The second waveguide may transform a circular planar wave at an entrance of the second waveguide into a rectangle planar wave with uniform power distribution at an exit of the second waveguide. The entrance of the second waveguide may be an annular ring divided into several input sections that transform into a rectangular output divided into the same number of output sections. Acoustic channels or paths acoustically interconnecting the input sections with respective ones of the output sections may all have a same expansion rate from input to output yielding equal acoustic impedances. The divided rectangular output may be symmetric in both horizontal and vertical cross sections.

In one embodiment, the invention is directed towards loudspeaker driver/horn combinations, and, more specifically, loudspeaker driver/horn combinations with specific directional behavior. One embodiment of the present invention has an annular ring input orifice, and a curved or planar rectangular output orifice. The input of the device may be coupled directly to an annular ring radiating diaphragm, a compression driver that has an annular ring acoustic output, a cone style transducer, or a pre-conditioning waveguide that transforms the circular exit of a compression driver into an annular ring. The input and output orifices may be connected by four or more discrete paths which are defined by thin wall divisions at the input and output. Practically speaking, the device may be constructed from three pieces, e.g., an upstream housing, a downstream housing, and a central part which includes the vanes or walls that define the acoustic paths between the two housings. These acoustic paths, or "exit paths" of the device may be symmetric in at least one plane that bisects the device. The exit of the device may be affixed to a rectangular horn entrance or may be mounted in a baffle.

The invention comprises, in one form thereof, an acoustic transformer including at least one outer boundary wall. A plurality of inner walls are disposed within the outer boundary wall. The outer boundary wall and the inner walls define an input opening divided by at least some of the inner walls into a plurality of input sections. A substantially annular output opening is divided by at least some of the inner walls into a plurality of circumferentially-spaced output sections. Each of the output sections has an inner circumferential side and an outer circumferential side. Each of a plurality of acoustic paths interconnects a respective one of the input sections with a respective one of the output sections. Each of the paths has a substantially equal path length and a substantially equal expansion rate.

The invention comprises, in another form thereof, an acoustic transformer, including at least one outer boundary wall. A plurality of inner walls are disposed within the outer boundary wall. The outer boundary wall and the inner walls define a circular input opening divided by at least some of the inner walls into a plurality of pie-shaped input sections. A substantially annular output opening is divided by at least some of the inner walls into a plurality of circumferentially-spaced output sections. Each of a plurality of air-filled acoustic paths interconnects a respective one of the input sections with a respective one of the output sections. Each of the paths is separated in an air-tight manner from each of the other paths.

The invention comprises, in yet another form thereof, an acoustic transformer including a substantially cone-shaped core. A frusto-conically-shaped outer boundary wall is in spaced relationship with an outer surface of the cone-shaped core. A plurality of inner walls are disposed between and interconnect the cone-shaped core and the outer boundary wall. The inner walls divide a space between the cone-shaped core and the outer boundary wall into a plurality of acoustic paths. Each of the paths has a substantially equal length and a substantially equal expansion rate.

The invention comprises, in still another form thereof, an acoustic waveguide including first and second opposite ends. The first end includes a substantially circular input. The second end includes a substantially annular ring output. A group of at least four divided passages interconnect the input and the output. The group of passages is symmetric relative to at least one plane.

An advantage of the waveguide of the present invention is that it exploits symmetry.

Another advantage is that the waveguide may operate on a greater variety of excitation waves, and has fewer requirements regarding what kind of excitation wave is acceptable.

Yet another advantage is that the waveguide does not rely on the pressure gradient at the waveguide entrance to be in a direction that is normal to the entrance. A reason for such flexibility is that the division of acoustic paths corrects wave components with non-normal pressure gradients.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
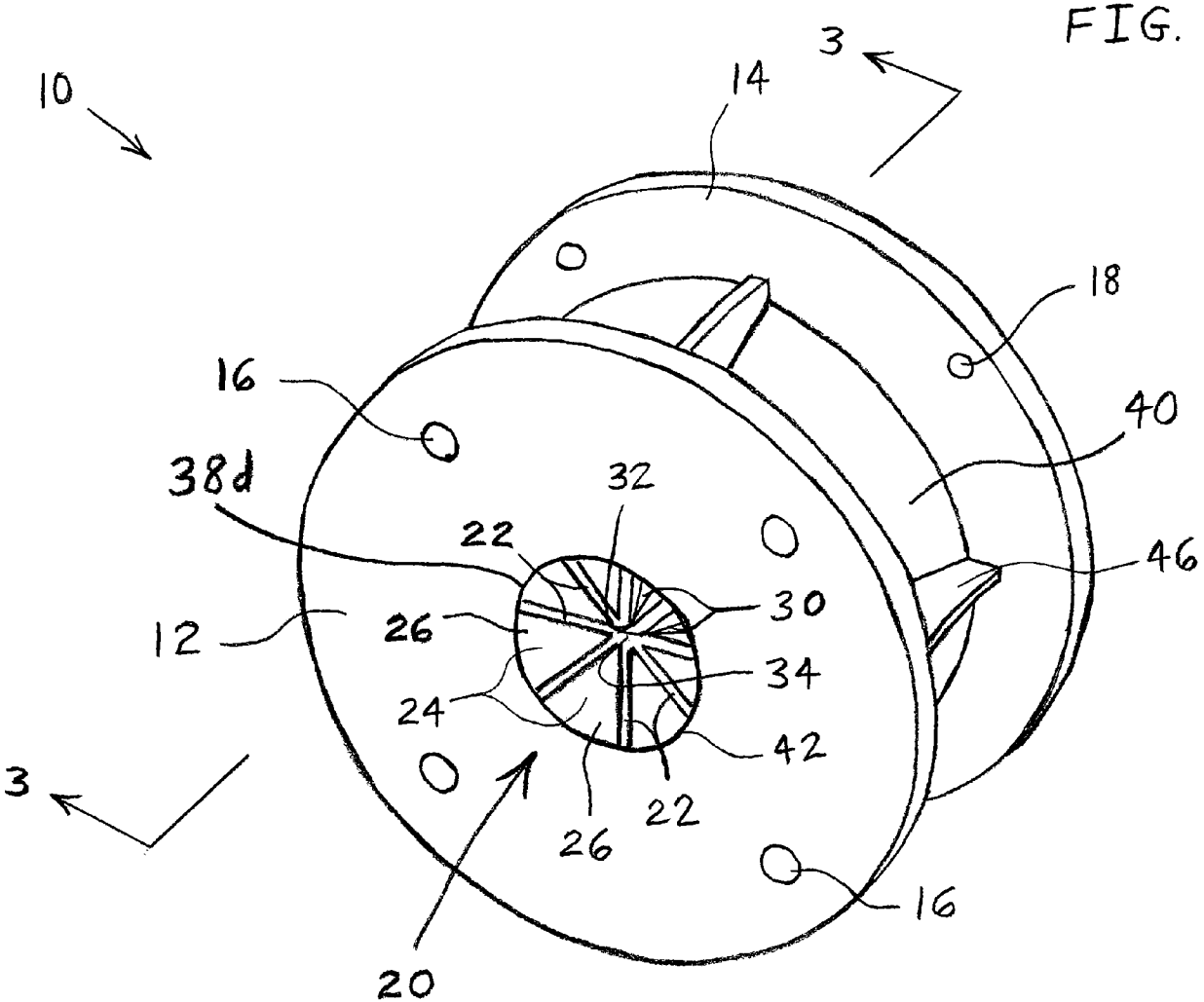
FIG. 1 is a perspective view from the input side of one embodiment of an acoustic waveguide of the present invention having a circular divided input.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings, and particularly to FIG. 1, there is shown one embodiment of an acoustic transformer or waveguide 10 of the present invention, including a circular input plate 12 and a circular output plate 14. Output plate 14 is oriented parallel to input plate 12. Input plate 12 has four equally-spaced bolt holes 16 each of which is aligned with a respective one of four bolt holes 18 in output plate 14.

Figure 2A:
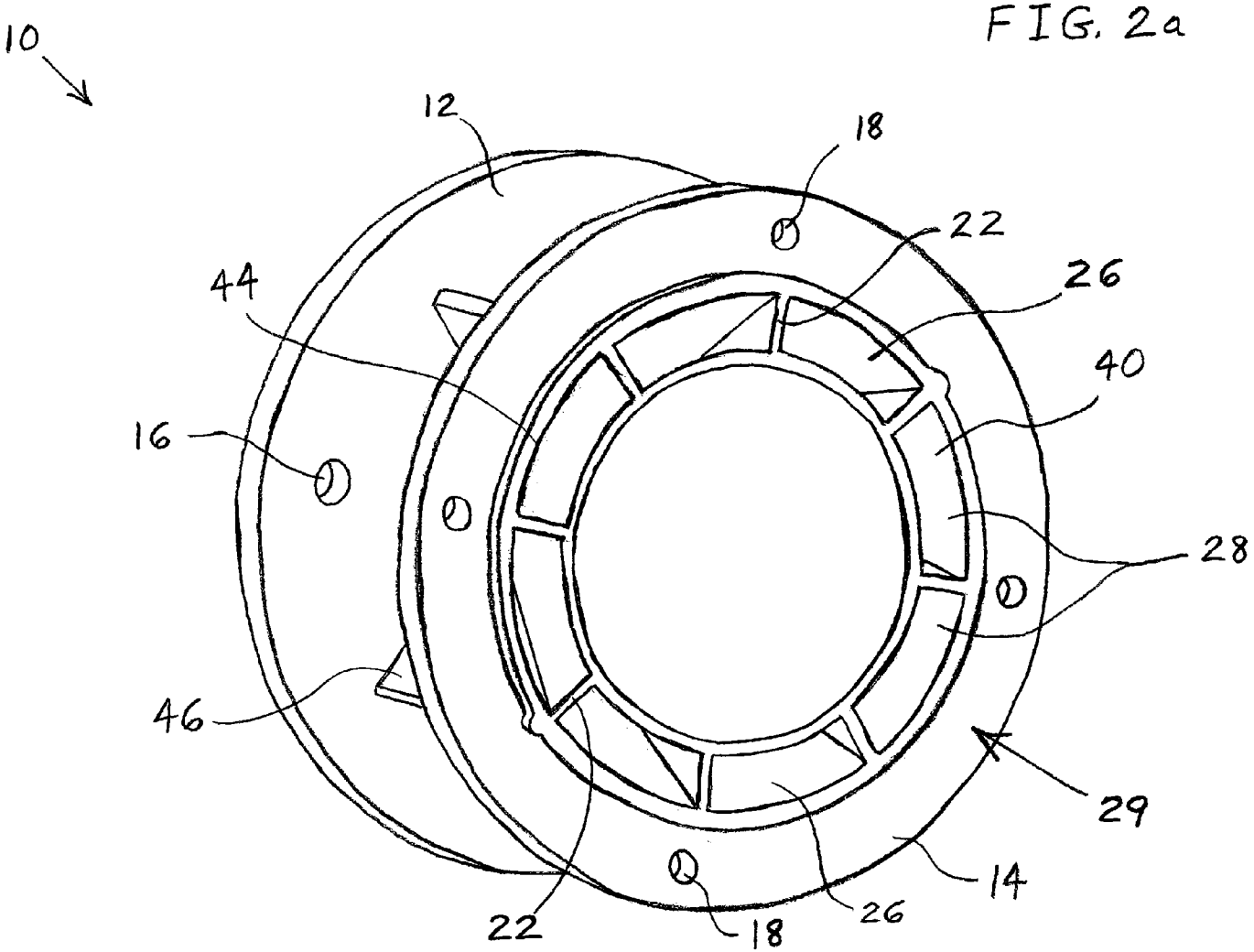
FIG. 2*a* is a perspective view from the output side of the acoustic waveguide of FIG. 1 having a divided annular ring output.

Input plate 12 has, and surrounds, a circular divided input 20 in the form of a through hole that extends through input plate 12. The through hole of input 20 is divided by radially-oriented inner walls 22 into eight equally-sized, pie-shaped entrance slots 24. Each of slots 24 leads into a respective one of eight channels 26. Each of channels 26 extends from input plate 12 to a respective one of eight arcuate exit through slots 28 (FIG. 2*a*) in output plate 14. Thus, each of channels 26 places a respective one of entrance slots 24 into fluid communication with a respective one of exit through slots 28.

The eight arcuate exit through slots 28 may be conjointly referred to as a divided annular ring output 29 of waveguide 10. Annular ring output 29 is divided into eight equally-sized and evenly-spaced sections 28.

Figure 2B:
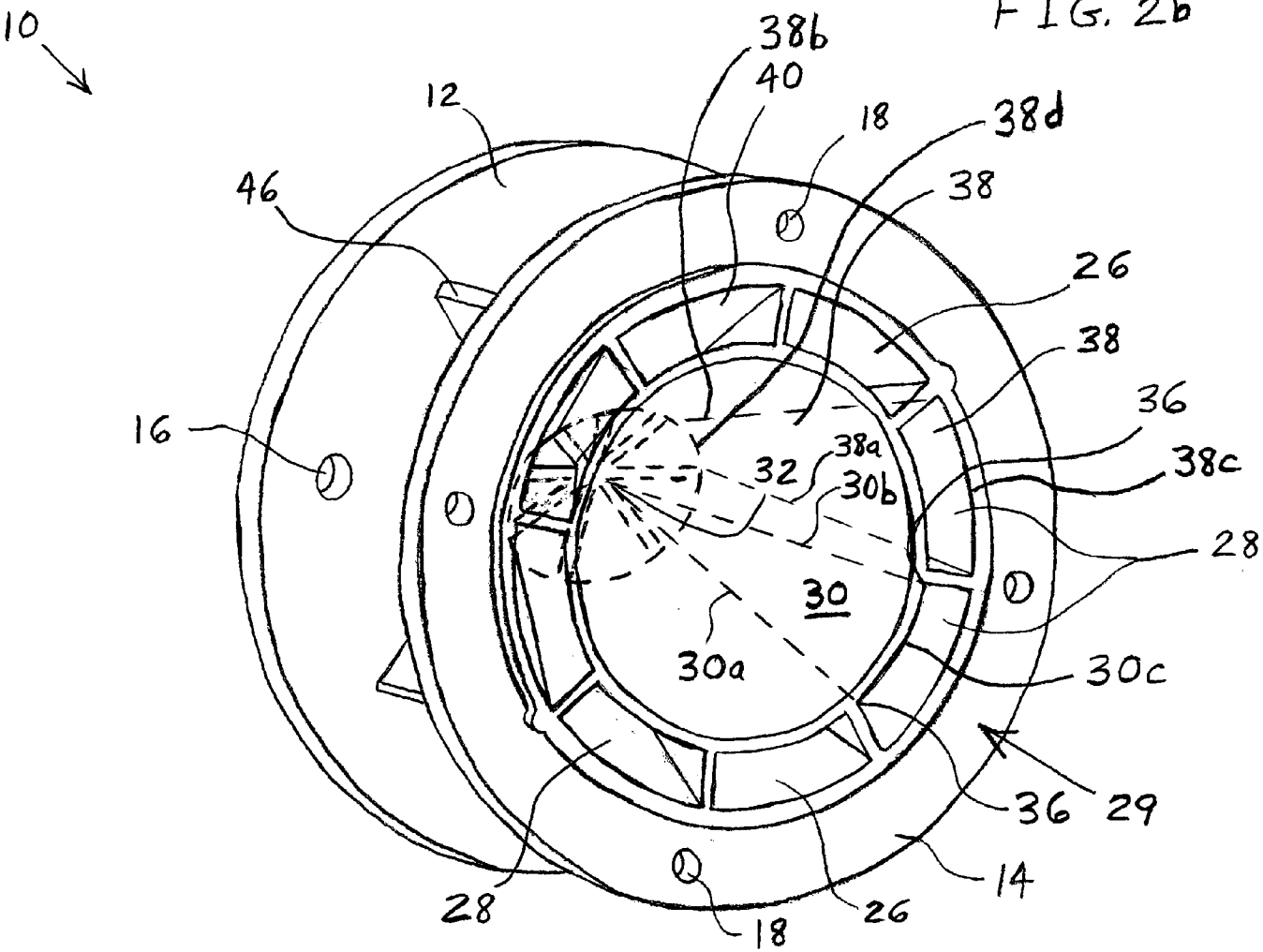
FIG. 2*b* is the view of FIG. 2*a* with the circular divided input of FIG. 1 shown in dashed lines.

Each of channels 26 is partially defined by two adjacent radially-oriented inner walls 22. Each of channels 26 is also partially defined by a respective one of eight substantially triangularly-shaped inner walls 30. Two walls 30 are visible in FIG. 1. In order to maintain clarity of illustration, only one wall 30 is shown in FIG. 2*b* in broken lines. Each of the eight triangular inner walls 30 has two substantially equal sides 30*a-b* and a third arcuate side 30*c* that also serves as the radially inward circumferential side of a respective exit through slot 28. Each of the eight triangular inner walls 30 has a corner 32 at a hub 34 of circular divided input 20. The other two corners of each triangular inner wall 30 are at respective ones of the two radially inward corners 36 of the respective arcuate exit through slots 28. Each of the acoustic channels 26 is partially defined by a respective one of the triangular walls 30.

Figure 3:
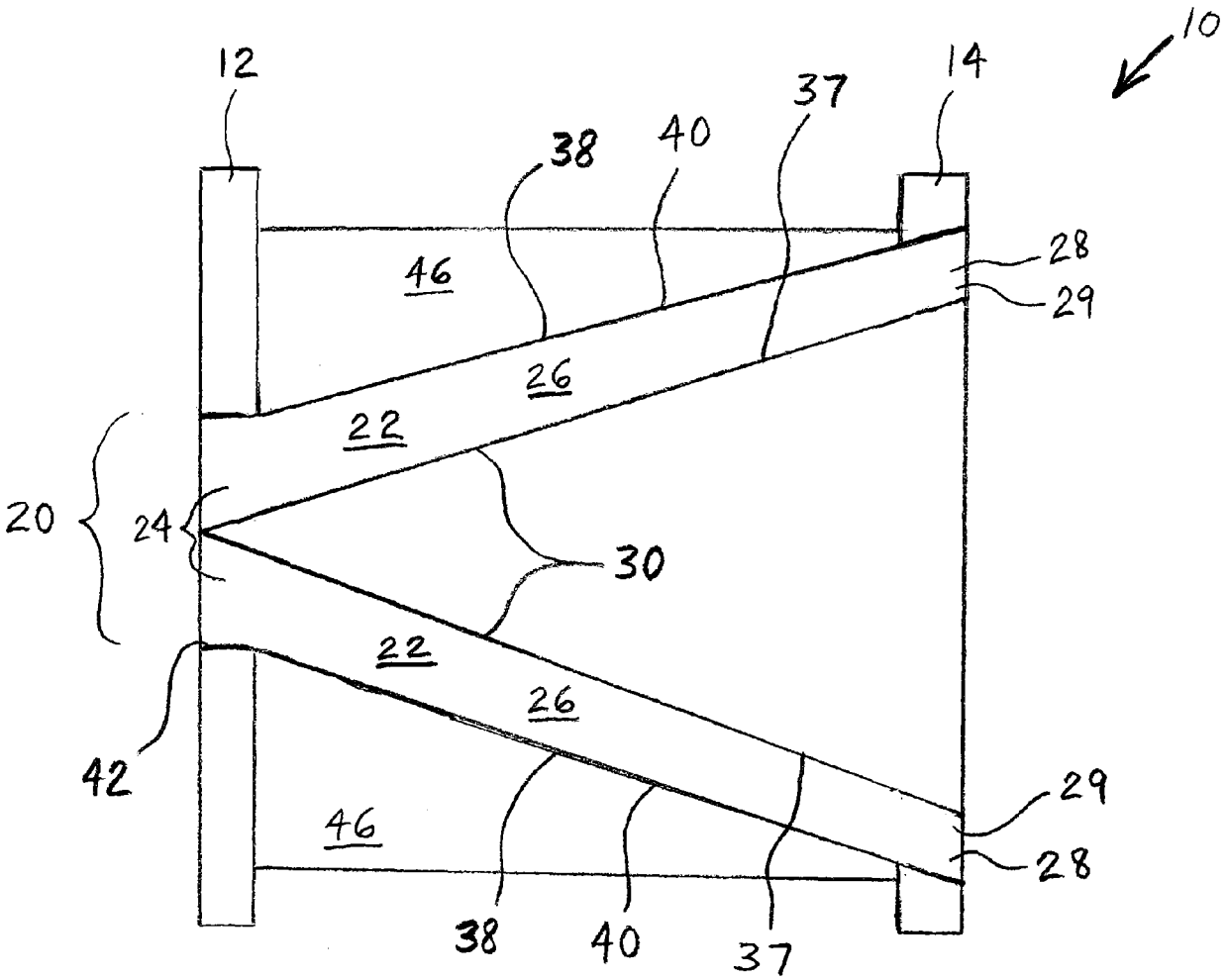
FIG. 3 is a side sectional view along line 3-3 in FIG. 1.

A cone 37, best shown in the cross-sectional side view of FIG. 3, forms the substantially triangularly-shaped inner walls 30. Cone 37 includes the eight inner walls 30 separated from each other by narrow strips at which radial walls 22 engage cone 37. Being that inner walls 30 are formed on a cone 37, each of walls 30 is somewhat arcuate in that it conforms to the surface of cone 37. Despite each of walls 30 being somewhat arcuate, each of walls 30 is essentially triangular.

Each of channels 26 is further partially defined by a respective substantially trapezoid-shaped section 38 of frusto-conically-shaped outer boundary wall 40. In order to maintain clarity of illustration, only one section 38 is shown in FIG. 2*b* in broken lines. Each of the eight trapezoid-shaped sections 38 has two substantially equal sides 38*a-b*, a third arcuate side 38*c* that also serves as the radially outward circumferential side of a respective exit through slot 28, and a fourth arcuate side 38*d* that also serves as the circumferential side of a respective pie-shaped entrance slot 24. Wall 40 includes the eight trapezoid-shaped sections 38 separated from each other by narrow strips at which radial walls 22 engage wall 40.

Frusto-conical outer boundary wall 40 extends from a circular circumference 42 of circular divided input 20 to the radially outward circumferential side 44 (FIG. 2*a*) of each of the eight arcuate exit through slots 28. Opposite edges of wall 40 may be attached to plate 12 and plate 14, respectively. Thus, wall 40 may be continuous between input plate 12 and output plate 14. Wall 40 may also be continuous throughout the entire 360 degrees of its circumference.

Being that sections 38 are formed on a frusto-conically-shaped wall 40, each of sections 38 is somewhat arcuate in that it conforms to wall 40. Despite each of sections 38 being somewhat arcuate, each of sections 38 is essentially trapezoidal.

Four trapezoid-shaped ribs 46 extend from input plate 12 to output plate 14 on the outer surface of boundary wall 40. Ribs 46 may provide added structural integrity to waveguide 10.

The present invention may assume that the power distribution of the input waveform is substantially consistent and predominantly symmetric. Regardless of the shape of the wave surface or the direction of the pressure gradient, waveguide 10 may separate the input wave-front into divisions of equal power and may guide the input wave-fronts into a divided annular ring. It has been shown that given a small enough waveguide, regardless of the shape of the input wave, the input wave tends to take the shape of a plane wave as the input wave propagates through the waveguide. Because each channel or path 26 in waveguide 10 may be identical, the path length and expansion functions may also be equal. Thus, from the input to waveguide 10 at input 20, a planar wave radiating annular ring with equal power distribution may be realized at output plate 14.

Cone 37 and boundary wall 40 are shown in FIG. 3 as being linear, or having a constant slope, between circular divided input 20 and divided annular ring output 29. However, it is to be understood that it is within the scope of the invention for either or both of cone 37 and wall 40 to be concave or convex instead of linear.

Figure 4:
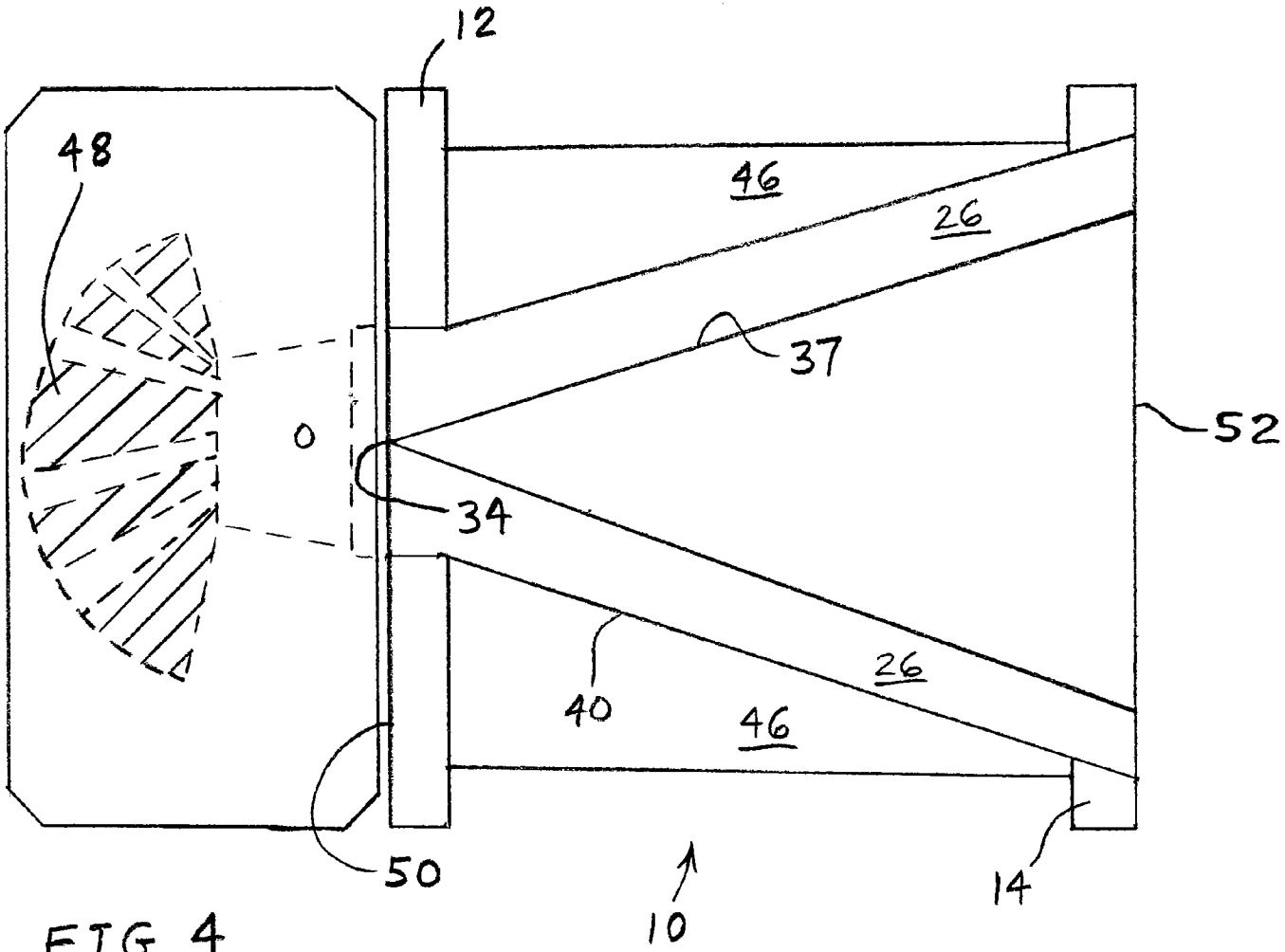
FIG. 4 is a view similar to FIG. 3 with the waveguide in use with a loudspeaker at the input of the waveguide.

The waveguide may be formed of any rigid molded material, such as metal, plastic, or resin, for example. Shown in FIG. 4 is waveguide 10 in use and fixed on a loudspeaker 48 at the input. Input plate 12 has a flat surface 50 opposite outer boundary wall 40. Flat surface 50 interfaces with loudspeaker 48. Similarly, output plate 14 has a substantially flat surface 52 opposite outer boundary wall 40. Output plate 14 is annular and surrounds output opening 29.

Acoustic transformer 10 includes an outer boundary wall 40, and inner walls 22, 37 disposed within outer boundary wall 40. Inner wall 37 is conically-shaped, and is divided into eight equally-sized and evenly-spaced triangular walls 30 around its circumference. Circular input plate 12 includes a through hole that serves as an input opening divided by inner walls 22 into a plurality of input sections 24. The input sections 24 conjointly form a circular divided input 20.

Circular output plate 14 includes, and surrounds, an annular output opening that is divided by inner walls 22 into a plurality of circumferentially-spaced output sections 28 that conjointly form a divided annular ring output 29. Each of output sections 28 has an inner circumferential side 30*c* and an outer circumferential side 38*c*, 44.

Each of eight acoustic paths 26 interconnects a respective one of input sections 24 with a respective one of the output sections 28. Each of the paths 26 has an equal path length and an equal expansion rate. The term "expansion rate" may indicate the rate at which the cross-sectional area of a path 26 increases from input plate 12 to output plate 14. Although each of the paths 26 has an equal expansion rate, the rate of expansion of the cross-sectional area of an individual path 26 may be different at different points along the progression of the path 26 from input plate 12 to output plate 14.

Outer boundary wall 40 and inner wall 37 define a circular input opening 20 divided by inner walls 22 into a plurality of pie-shaped sections 24. Annular output opening 29 is divided by inner walls 22 into a plurality of circumferentially-spaced output sections 28. Each of a plurality of air-filled acoustic paths 26 interconnects a respective one of the input sections 24 with a respective one of the output sections 28. Each of paths 26 may be separated in an air-tight manner from each of the other paths 26. That is, fluid (e.g., air) or sound waves may not be able to transfer from one channel 26 to another channel 26 between circular divided input 20 and divided annular ring output 29.

Frusto-conically-shaped outer boundary wall 40 is in spaced relationship with an outer surface of a cone-shaped core 37. Inner walls 22 are disposed between and interconnect the cone-shaped core and the outer boundary wall. Inner walls 22 divide a space between cone-shaped core 37 and outer boundary wall 40 into a plurality of acoustic paths 26. Each of paths 26 has a substantially equal length such that sound waves may travel an equal distance through any of paths 26 between an input and an output of waveguide 10. Each of paths 26 may have a substantially equal expansion rate such that a first derivative of the cross-sectional area of each path 26 as a function of the position along the length of the path is equal at each position along the length of the path. Further, a second derivative of the cross-sectional area of each path 26 may also be equal at any point along the length of the path.

Figure 5:
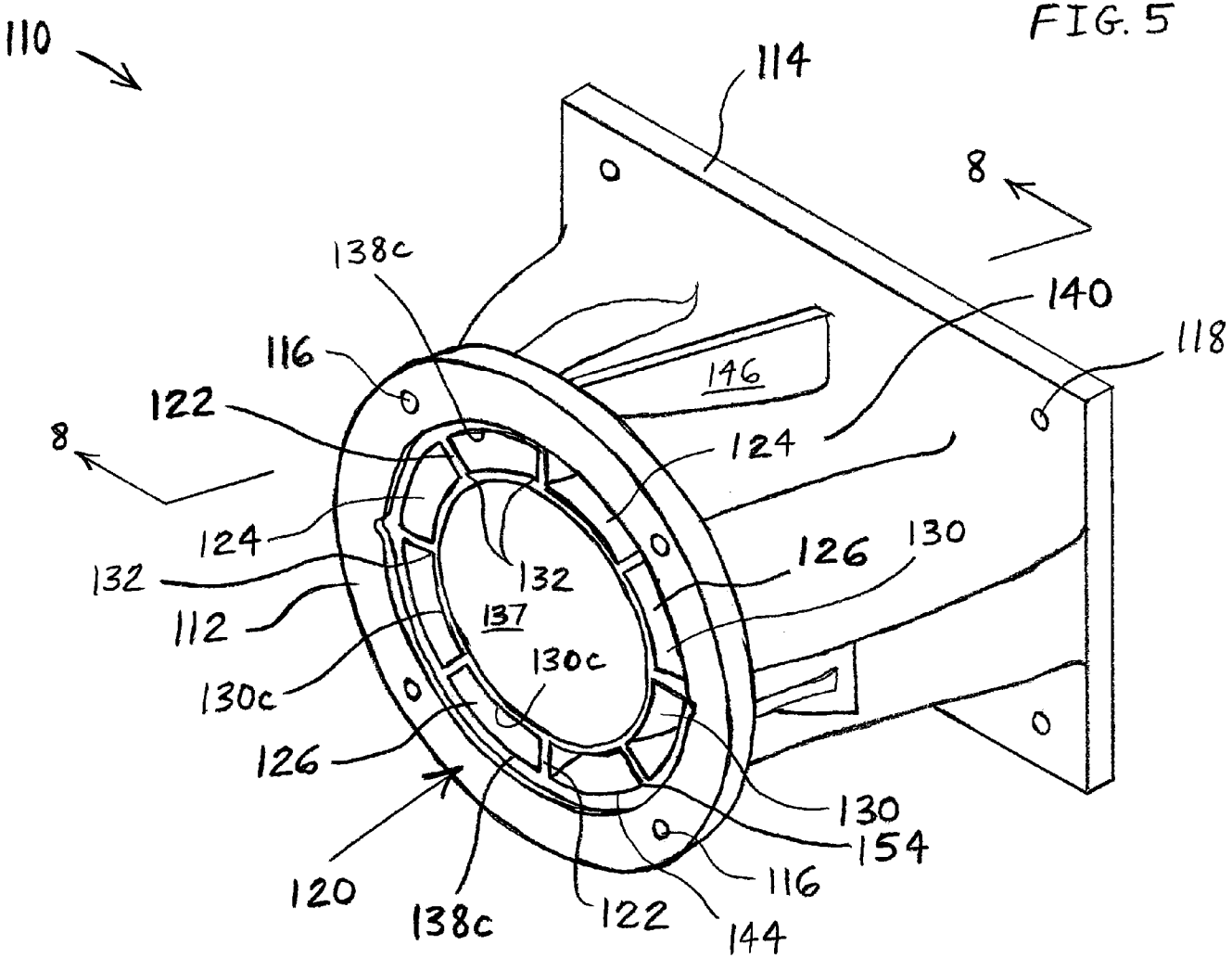
FIG. 5 is a perspective view from the input side of another embodiment of an acoustic waveguide of the present invention having a divided annular ring input for interfacing with the divided annular ring output of the acoustic waveguide of FIGS. 1-4.

In FIG. 5 there is shown another embodiment of an acoustic transformer or waveguide 110 of the present invention, including a circular input plate 112 and a rectangular output plate 114. Output plate 114 is oriented parallel to input plate 112. Input plate 112 has four equally-spaced bolt holes 116. Similarly, output plate 114 has four equally-spaced bolt holes 118.

Circular input plate 112 includes and surrounds an annular input opening that extends through input plate 112. The annular input opening is divided by inner walls 122 into a plurality of circumferentially-spaced and equally-sized input sections 124 that conjointly form a divided annular ring input 120. Each of the eight arcuate input sections 124 has an inner circumferential side 130*c* and an outer circumferential side 138*c*.

Each of the eight input sections 124 leads into a respective one of eight channels 126. Each of channels 126 extends from input plate 112 to a respective one of eight rectangular exit through slots 128 (FIG. 6) in output plate 114. Thus, each of channels 126 places a respective one of input sections 124 into fluid communication with a respective one of exit through slots 128.

The eight rectangular exit through slots 128 may be conjointly referred to as a divided rectangular output 129 of waveguide 110. Rectangular output 129 is divided into eight equally-sized and evenly-spaced slots 128 arranged in a matrix. In this particular embodiment, the matrix includes two rows and four columns of slots 128.

Each of channels 126 is partially defined by two adjacent inner walls 122. Walls 122 are radially-oriented at plate 112, and are oriented in a same direction at plate 114. This same direction of orientation is in substantially vertical directions 131 with respect to the viewing angle of FIG. 6. Each of channels 126 is also partially defined by a respective one of eight twistingly rectangular inner walls 130. Each of the eight substantially rectangular inner walls 130 has two opposite sides 133 (FIG. 7*a*). A third arcuate side 130*c* also serves as the radially inward circumferential side of a respective input section 124. Each of the eight rectangular inner walls 130 has two corners 132 corresponding to two radially inward corners of the respective arcuate input section 124. Each of the eight rectangular inner walls 130 also has two opposite corners 134 corresponding to two inside corners of the respective exit through slot 128. Pairs of opposite corners 134 are joined by a fourth linear side 130*d* which also serves as the inner side of a respective output slot 128. Each of the acoustic channels 126 is partially defined by a respective one of the rectangular walls 130.

Figure 8:
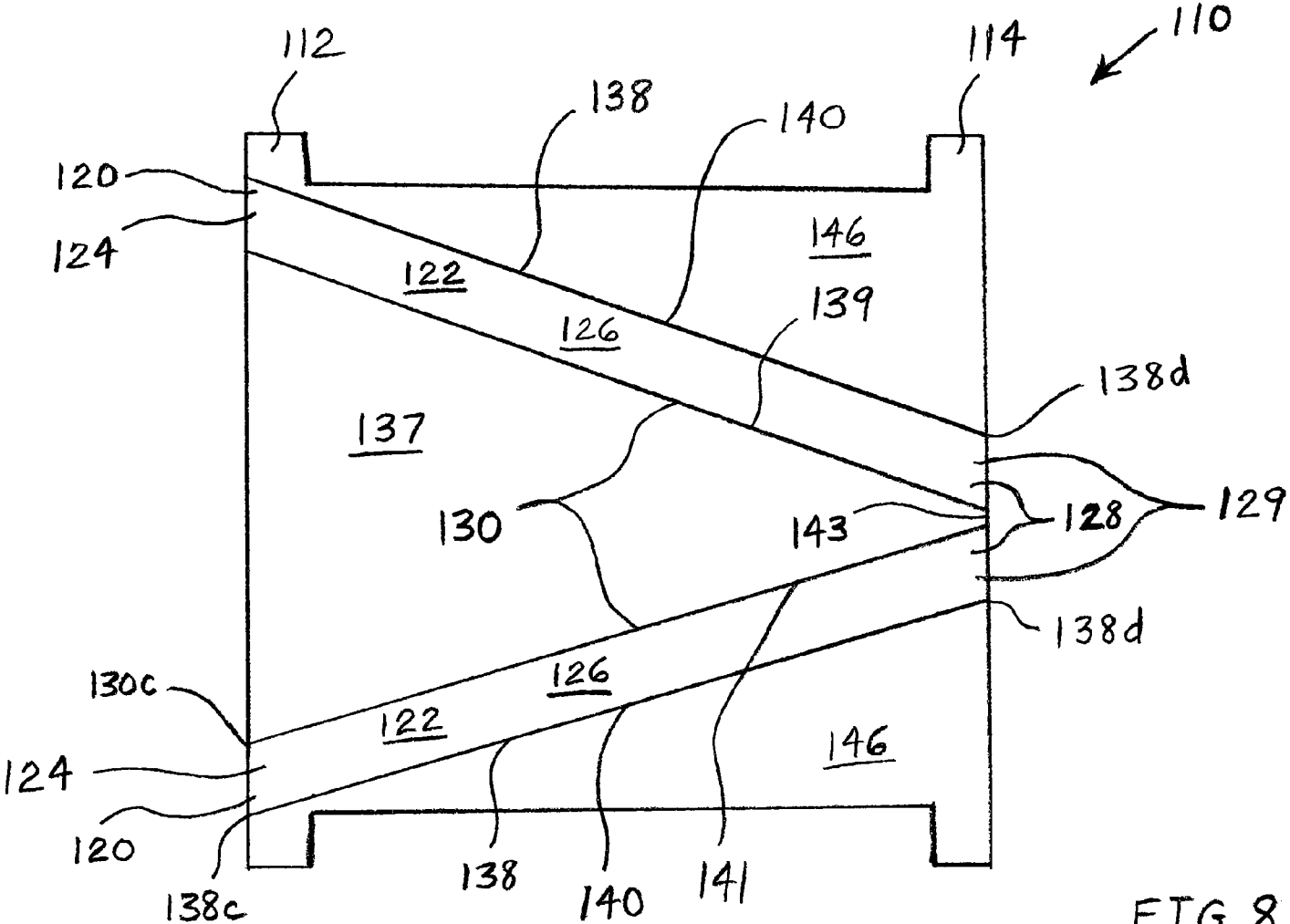
FIG. 8 is a side sectional view along line 8-8 in FIG. 5.

A core 137, which has a substantially triangular cross section in the view of FIG. 8, forms the substantially rectangular inner walls 130. Core 137 includes the eight inner walls 130, with four walls 130 on an upper side 139 of core 137 and four walls 130 on a lower side 141 of core 137. Walls 130 on a same side of core 137 are separated from each other by narrow strips at which walls 122 engage core 137. Core 137 has a circular base at one end, as best shown in FIG. 5, and comes to a thin, rectangular edge or blade 143 at the other end. Accordingly, each of walls 130 is somewhat arcuate and twisting in that it conforms to the surface of core 137. Despite each of walls 130 being somewhat arcuate and twisting, each of walls 130 is essentially rectangular.

Figure 7A:
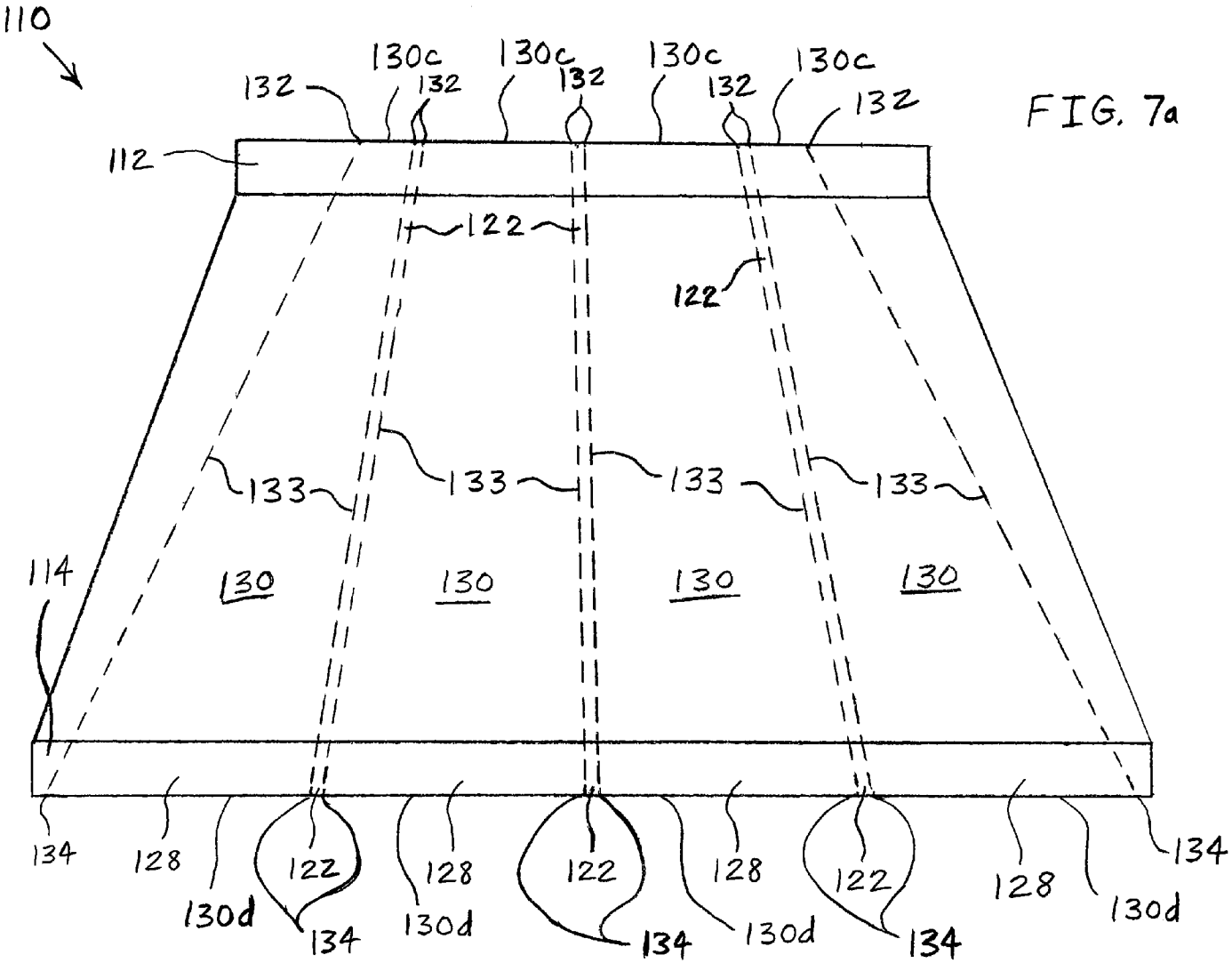
FIG. 7*a* is a sectional view along line 7*a*-7*a* in FIG. 6.
Figure 7B:
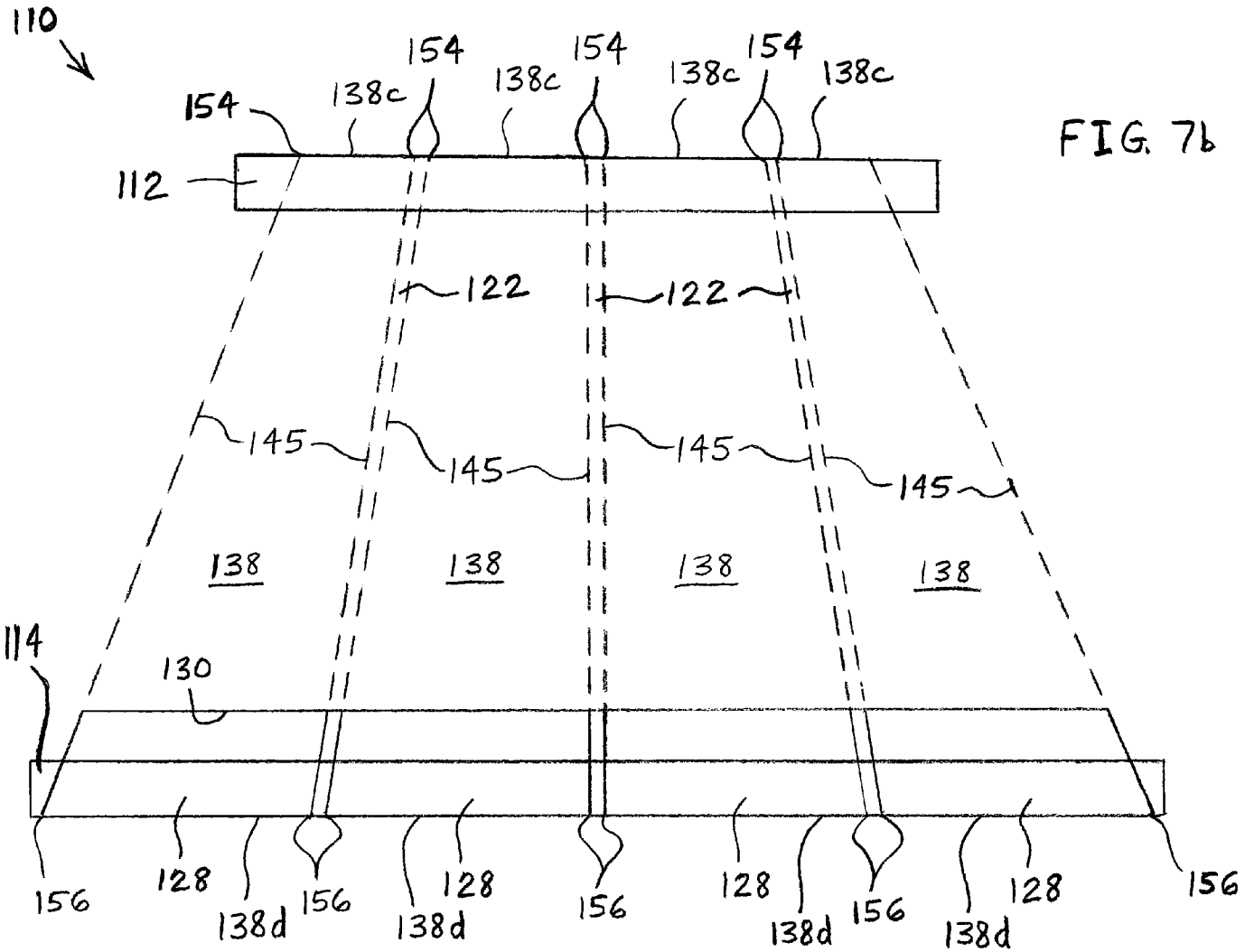
FIG. 7*b* is a sectional view along line 7*b*-7*b* in FIG. 6.

Each of channels 126 is further partially defined by a respective substantially rectangular outer wall 138 that is on an inner surface of an outer boundary wall 140. Each of the eight rectangular walls 138 has two opposite sides 145 (FIG. 7*b*). A third arcuate side 138*c* also serves as the radially outward circumferential side of a respective input section 124. Each of the eight rectangular outer walls 138 has two corners 154 corresponding to two radially outward corners of the respective arcuate input section 124. Each of the eight rectangular outer walls 138 also has two opposite corners 156 corresponding to two outside corners of the respective exit through slot 128. Pairs of opposite corners 156 are joined by a fourth linear side 138*d* which also serves as the outer side of a respective output slot 128. Each of the acoustic channels 126 is partially defined by a respective one of the rectangular walls 138.

Outer boundary wall 140 extends from the radially outward circumferential side 144 (FIG. 5) of each of the eight arcuate input sections 124 to outer sides 138*d* of output slots 128. Opposite edges of outer wall 140 may be attached to plate 112 and plate 114, respectively. Thus, wall 140 may be continuous between input plate 112 and output plate 114. Outer wall 140 may also be continuous throughout the entire 360 degrees around its outer surface.

Being that walls 138 are formed on an arcuate and twisting outer wall 140, each of walls 138 is somewhat arcuate and twisting in that it conforms to outer wall 140. Despite each of walls 138 being somewhat arcuate and twisting, each of walls 138 is essentially rectangular.

A plurality of trapezoid-shaped ribs 146 extend from input plate 112 to output plate 114 on the outer surface of boundary wall 140. Ribs 146 may provide added structural integrity to waveguide 110.

Core 137 and boundary wall 140 are shown in FIG. 8 as being linear, or having a constant slope, between divided annular ring input 120 and divided rectangular output 129. However, it is to be understood that it is within the scope of the invention for either or both of core 137 and wall 140 to be concave or convex instead of linear.

As best shown in FIG. 8, the inner walls inside outer boundary wall 140 include side walls 122, which are substantially rectangular. Each of side walls 122 may be oriented substantially perpendicular to an outer surface of either upper side 139 or lower side 141 of wedge-shaped core 137. Each of acoustic paths 126 is partially defined by at least one of rectangular side walls 122.

Figure 9:
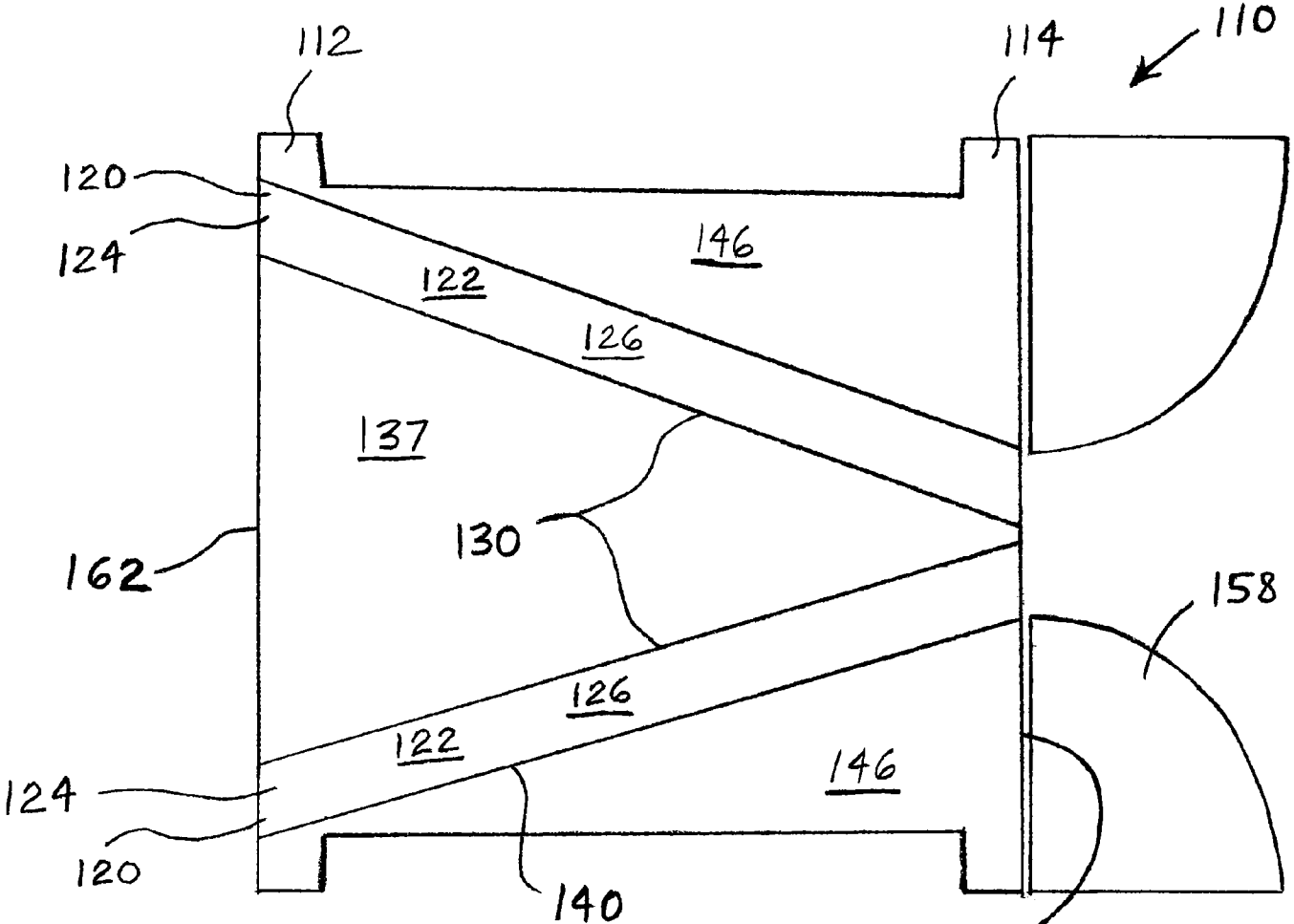
FIG. 9 is a view similar to FIG. 8 with the waveguide in use with a dome at the output of the waveguide.

Waveguide 110 may be formed of any rigid molded material, such as metal, plastic, or resin, for example. Shown in FIG. 9 is waveguide 110 fixed to a dome 158 at the output. Output plate 114 has a flat surface 160 opposite outer boundary wall 140. Flat surface 160 interfaces with dome 158. Similarly, input plate 112 has a substantially flat surface 162 opposite outer boundary wall 140.

Acoustic transformer 110 includes an outer boundary wall 140, and inner walls 122, 137 disposed within outer boundary wall 140. Inner wall 137 is substantially wedge-shaped, and its opposite faces are divided into eight evenly-spaced, substantially rectangular walls 130. Circular input plate 112 includes an annular through hole that serves as an input opening divided by inner walls 122 into a plurality of input sections 124. The input sections 124 conjointly form an annular divided input 120.

Rectangular output plate 114 includes and surrounds a divided rectangular output opening that is divided by inner walls 122 into two rows of four rectangular output sections 126 that conjointly form a divided rectangular output 129. Each of output sections 126 has a linear inner 130*d* and a linear outer side 138*d*.

Each of eight acoustic paths 126 interconnects a respective one of input sections 124 with a respective one of the output slots 128. In one embodiment, each of the paths 126 has a substantially equal path length and a substantially equal expansion rate. The term "expansion rate" may indicate the rate at which the cross-sectional area of a path 126 increases from input plate 112 to output plate 114. Although each of the paths 126 may have an equal expansion rate, the rate of expansion of the cross-sectional area of an individual path 126 may still be different at different points along the progression of the path 126 from input plate 112 to output plate 114.

Outer boundary wall 140 and inner wall 137 define an annular input opening 120 divided by inner walls 122 into a plurality of arcuately rectangular sections 124. Rectangular output opening 129 is divided by inner walls 122 into a plurality of evenly-spaced, rectangular output slots 128. Each of a plurality of air-filled acoustic paths 126 interconnects a respective one of the input sections 124 with a respective one of the output slots 128. Each of paths 126 may be separated in an air-tight manner from each of the other paths 126. That is, fluid (e.g., air) or sound waves may not be able to transfer from one channel 126 to another channel 126 between divided annular input 120 and divided rectangular output 129.

Outer boundary wall 140 is in spaced relationship with an outer surface of a wedge-shaped core 137. Inner walls 122 are disposed between and interconnect the wedge-shaped core and the outer boundary wall. Inner walls 122 divide a space between wedge-shaped core 137 and outer boundary wall 140 into a plurality of acoustic paths 126. Each of paths 126 may have a substantially equal length such that sound waves may travel a substantially equal distance through any of paths 126 between an input and an output of waveguide 110. Each of paths 126 may have a substantially equal expansion rate such that a first derivative of the cross-sectional area of each path 126 as a function of the position along the length of the path is equal at each position along the length of the path. Further, a second derivative of the cross-sectional area of each path 126 may also be equal at any point along the length of the path.

Figure 10:
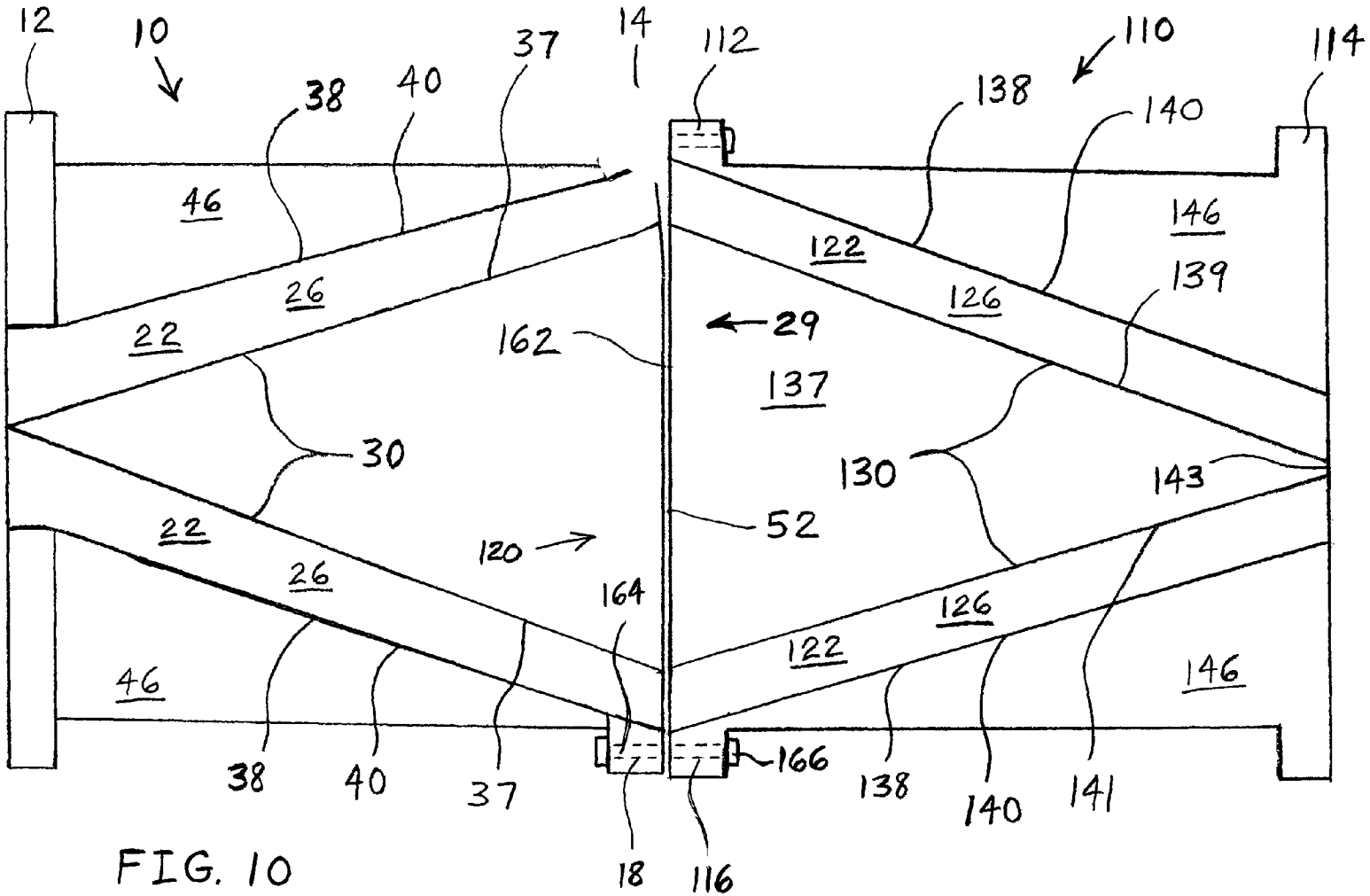
FIG. 10 is a side sectional view of the waveguide of FIG. 1 operationally attached to the waveguide of FIG. 5.

As shown in FIG. 10, the substantially planar input surface 162 of waveguide 110 may be attached, interfaced and/or sealed to the substantially planar output surface 52 of waveguide 10. To this end, throughholes 18 of output plate 14 may be aligned with throughholes 116 of input plate 112. A bolt 164 may be passed through each aligned pair of throughholes 18, 116, and bolt 164 may be secured within throughholes 18, 116 by a nut 166 to thereby securely attach waveguide 10 to waveguide 110. Thus, annular divided ring input 120 of waveguide 110 is mated to, and aligned with, the annular divided ring output 29 of waveguide 10.

As further shown in FIG. 10, the flat input surface 162 of waveguide 110 may be attached in association with a flat output surface 52 of waveguide 10. Flat surface 52 has an annular output opening 29 of approximately a same size as the annular input opening 120 of flat surface 162. When through holes 18 of plate 14 are aligned with through holes 116 of plate 112, output sections 28 of waveguide 10 are each aligned with a respective one of input sections 124 of waveguide 110. Thus, a plurality of substantially continuous acoustic paths may be established between circular input opening 20 and rectangular output opening 129.

As described above, waveguide 110 further terminates in a horizontally and vertically symmetric rectangular exit 129. Divided paths 126 may be constructed to have equal path lengths and equal expansion rates (and thus equal volume) on a single quadrant of waveguide 110. The quadrant geometry may be mirrored in the horizontal and vertical construction planes, as may be observed from FIGS. 5 and 6. Waveguide 110 may transform the annular ring input source into a rectangular output source. Each path 126 may have equal power distribution and equal impedance. Thus, symmetry may be exploited by waveguide 110.

Although input 120 of waveguide 110 is shown in FIG. 10 as being coupled to output 29 of waveguide 10, waveguide 110 could alternatively be coupled directly to a compression driver, such as a loudspeaker, having an annular ring output. Moreover, waveguide 110 could terminate in various, different and/or more exotic geometries depending upon the final application requirements.

Acoustic paths 26 and 126 of waveguides 10 and 110 are described herein as possibly having equal rates of expansion. It is to be understood that where the term "rate of expansion" or similar language is used herein, the term encompasses the possibility that the rate of expansion is negative relative to a direction from the input toward the output. That is, the equal expansion rates of the acoustic paths may be negative. Stated differently, the acoustic paths may have equal rates of contraction.

Figure 11:
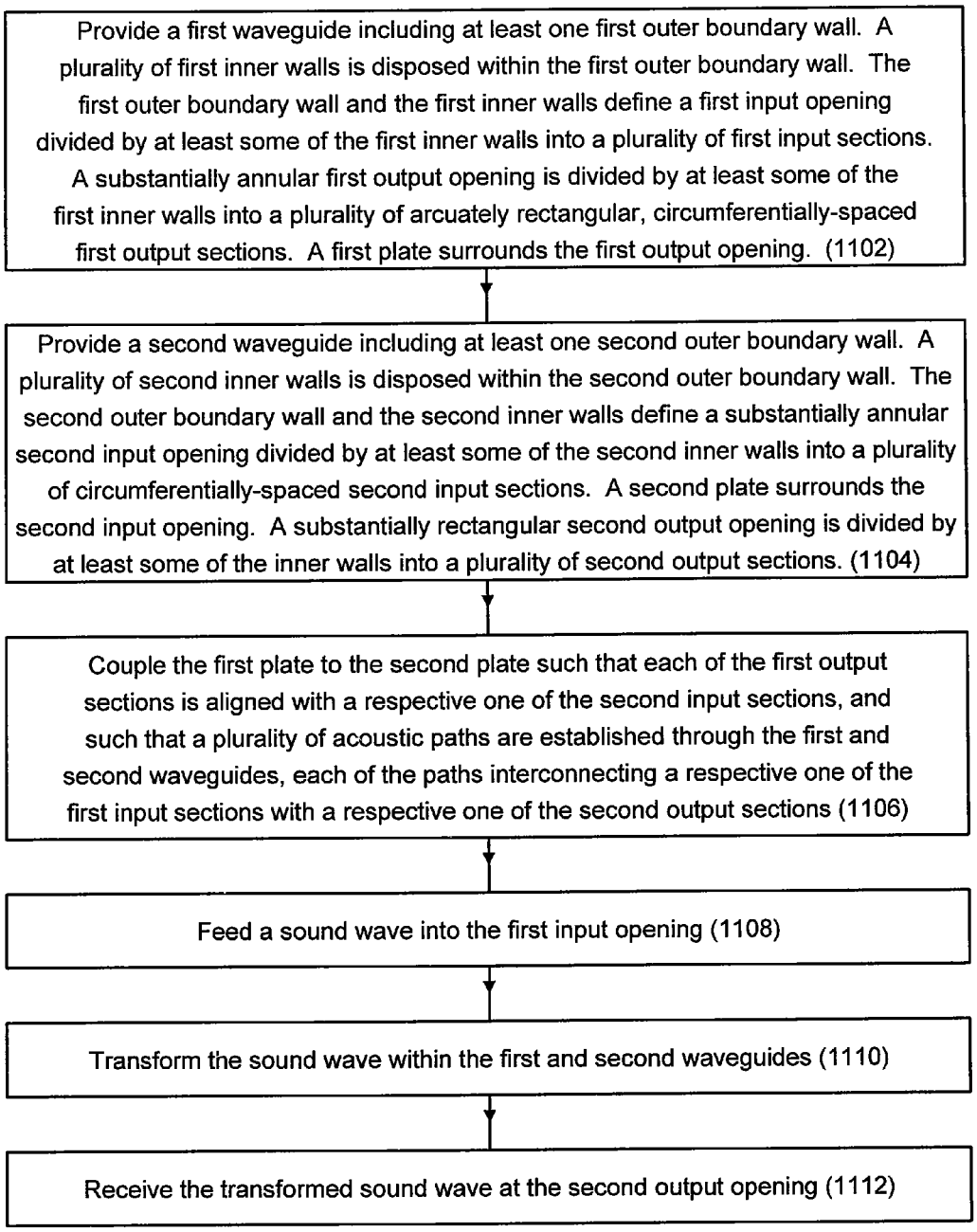
FIG. 11 is a flow chart illustrating one embodiment of an acoustic transformation method of the present invention.

One embodiment of an acoustic transformation method 1100 of the present invention is illustrated in FIG. 11. In a first step 1102, a first waveguide is provided including at least one first outer boundary wall. A plurality of first inner walls is disposed within the first outer boundary wall. The first outer boundary wall and the first inner walls define a first input opening divided by at least some of the first inner walls into a plurality of first input sections. A substantially annular first output opening is divided by at least some of the first inner walls into a plurality of arcuately rectangular, circumferentially-spaced first output sections. A first plate surrounds the first output opening. For example, waveguide 10 includes inner walls 22, 30 disposed within outer boundary wall 40. Outer boundary wall 40 and inner walls 22, 30 define input opening 20, which is divided by inner walls 22 into input sections 24. Annular first output opening 29 is divided by inner walls 22 into arcuately rectangular, circumferentially-spaced output sections 28. Plate 14 surrounds output opening 29.

In a next step 1104, a second waveguide is provided including at least one second outer boundary wall. A plurality of second inner walls is disposed within the second outer boundary wall. The second outer boundary wall and the second inner walls define a substantially annular second input opening divided by at least some of the second inner walls into a plurality of circumferentially-spaced second input sections. A second plate surrounds the second input opening. A substantially rectangular second output opening is divided by at least some of the inner walls into a plurality of second output sections. For instance, waveguide 110 includes inner walls 122, 130 disposed within outer boundary wall 140. Outer boundary wall 140 and inner walls 130 define annular input opening 120, which is divided by inner walls 122 into circumferentially-spaced input sections 124. Plate 112 surrounds input opening 120. A rectangular output opening 129 is divided by inner walls 122 into output sections 128.

Next, in step 1106, the first plate is coupled to the second plate such that each of the first output sections is aligned with a respective one of the second input sections, and such that a plurality of acoustic paths are established through the first and second waveguides, each of the paths interconnecting a respective one of the first input sections with a respective one of the second output sections. For example, as shown in FIG. 10, plate 14 is coupled to plate 112 such that each of output sections 28 is aligned with a respective one of input sections 124, and such that acoustic paths are established through waveguides 10 and 110. Each of the acoustic paths interconnects a respective one of input sections 24 with a respective one of output sections 128. That is, each acoustic path interconnecting a respective input section 24 with a respective output section 128 includes a respective acoustic path 26 and a respective acoustic path 126.

In a next step 1108, a sound wave is fed into the first input opening. That is, as shown in FIG. 4, a loudspeaker 48 may be used to direct sound waves into input opening 20.

In step 1110, the sound wave is transformed within the first and second waveguides. For instance, a planar or non-planar sound wave fed into input opening 20 by loudspeaker 48 may be transformed within waveguide 10 into a planar, annular wave with uniform power distribution at output opening 29. Within waveguide 110, the planar, annular wave may be further transformed into a planar, rectangular wave with uniform power distribution at output opening 129.

In a final step 1112, the transformed sound wave is received at the second output opening. For example, as shown in FIG. 9, the sound wave that is transformed within waveguides 10, 110 may be received by dome 158 at output opening 129.

Figure 12:
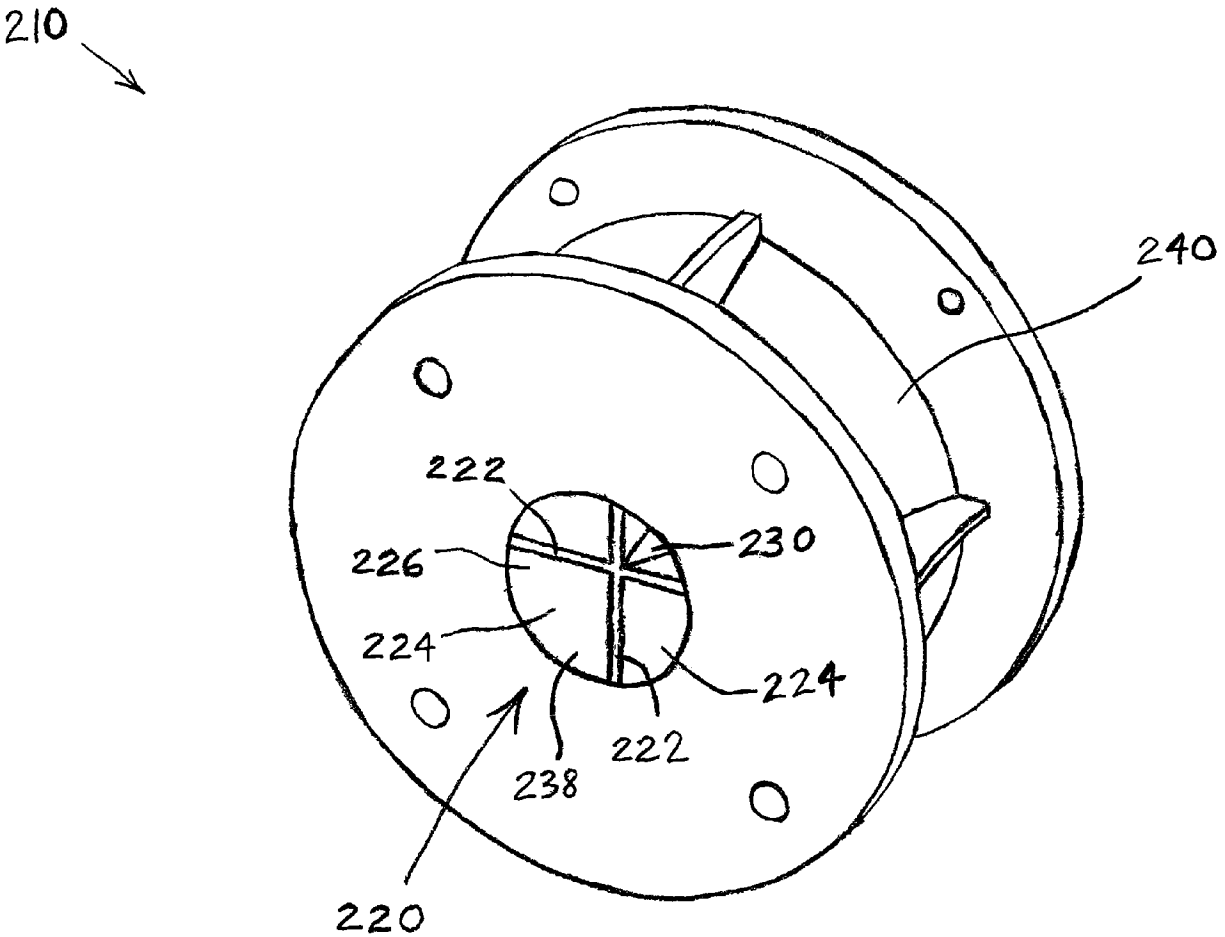
FIG. 12 is a perspective view from the input side of yet another embodiment of a pre-conditioning acoustic waveguide of the present invention having a circular divided input for transforming the circular exit of a compression driver into an annular ring.
Figure 13:
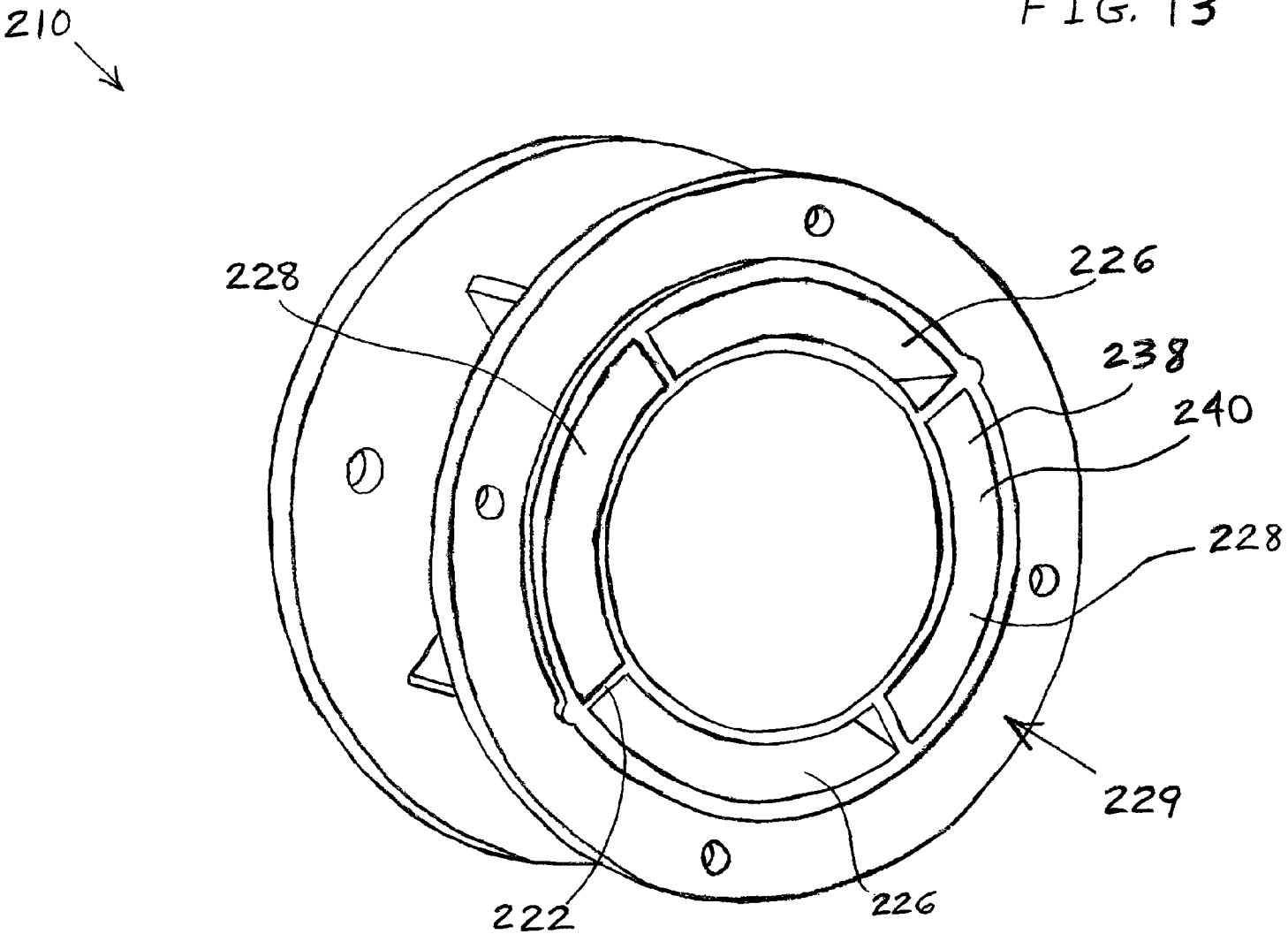
FIG. 13 is a perspective view from the output side of the acoustic waveguide of FIG. 12 having a divided annular ring output.

Waveguides 10 and 110 are shown as each having eight separate acoustic paths. However, it is to be understood that a waveguide of the invention can have a number of acoustic paths other than eight. For example, in FIG. 12, there is shown yet another embodiment of an acoustic transformer or waveguide 210 of the present invention in the form of a pre-conditioning waveguide that may transform the circular acoustic output of a compression driver into an annular ring. Waveguide 210 includes a circular divided input 220 in the form of a through hole divided by radially-oriented inner walls 222 into four equally-sized, pie-shaped entrance slots 224. Each of slots 224 leads into a respective one of four channels 226. Each of channels 226 extends from input 220 to a respective one of four arcuate exit through slots 228 (FIG. 13). Thus, each of channels 226 places a respective one of entrance slots 224 into fluid communication with a respective one of exit through slots 228.

The four arcuate exit through slots 228 may be conjointly referred to as a divided annular ring output 229 of waveguide 210. Annular ring output 229 is divided into four equally-sized and evenly-spaced sections 228.

Each of channels 226 is partially defined by two adjacent radially-oriented inner walls 222. Each of channels 226 is also partially defined by a respective one of four substantially triangularly-shaped inner walls 230. Only one wall 230 is visible in FIG. 12.

Each of channels 226 is further partially defined by a respective substantially trapezoid-shaped section 238 of frusto-conically-shaped outer boundary wall 240. Wall 240 includes the four trapezoid-shaped sections 238 separated from each other by narrow strips at which radial walls 222 engage wall 240. Other features of waveguide 210 are substantially similar to those of waveguide 10, and thus are not described herein in order to avoid needless repetition.

Figure 14:
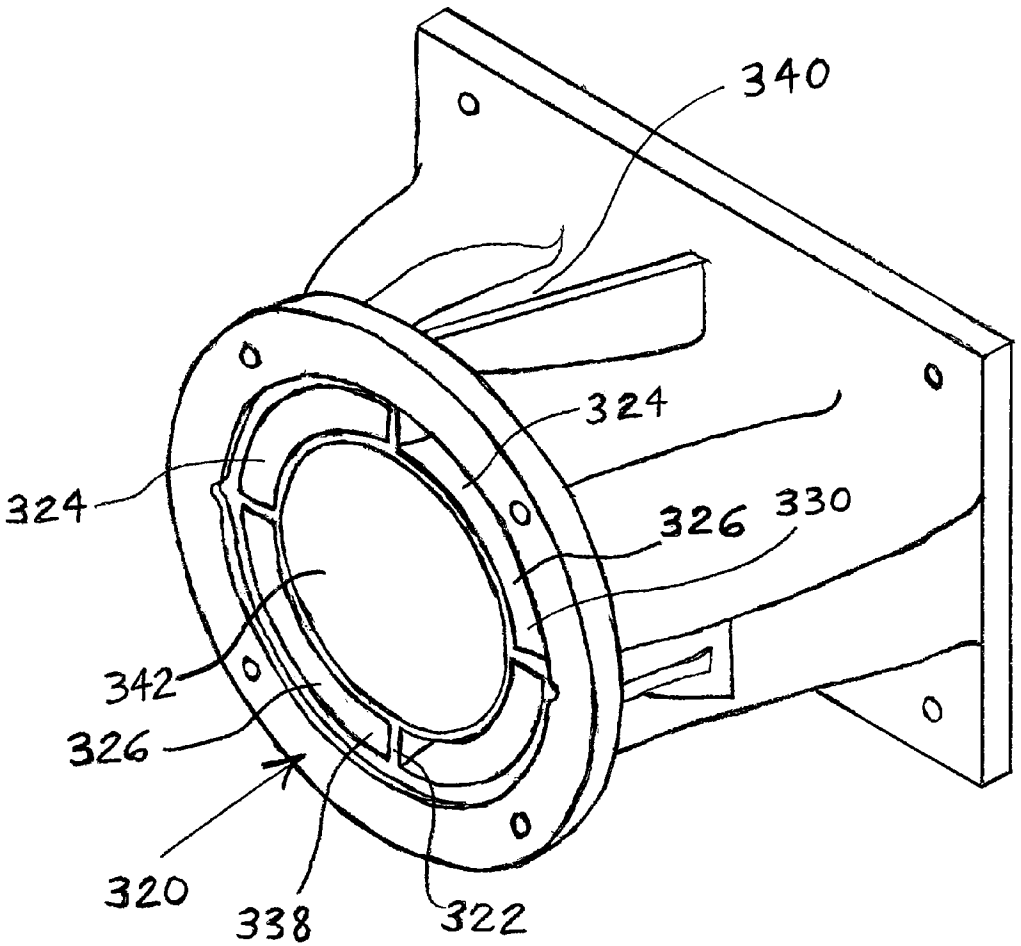
FIG. 14 is a perspective view from the input side of still another embodiment of an acoustic waveguide of the present invention having a divided annular ring input for interfacing with the divided annular ring output of the acoustic waveguide of FIG. 13.

In FIG. 14 there is shown another embodiment of an acoustic transformer or waveguide 310 of the present invention that has four acoustic paths. Waveguide 310 includes an annular input opening divided by inner walls 322 into four circumferentially-spaced and equally-sized input sections 324 that conjointly form a divided annular ring input 320.

Figure 15:
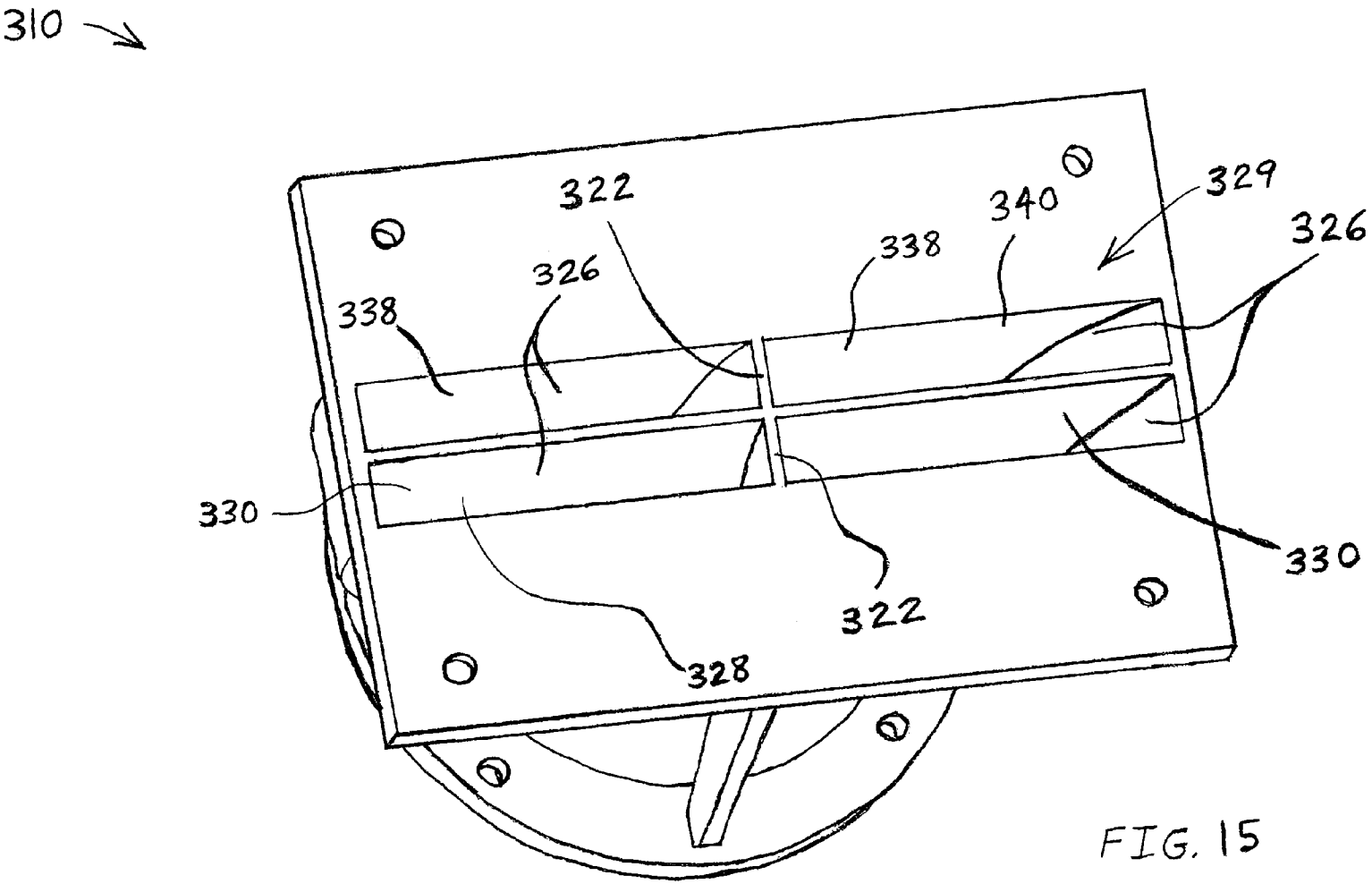
FIG. 15 is a perspective view from the output side of the acoustic waveguide of FIG. 14 having a divided rectangular output.

Each of the four input sections 324 leads into a respective one of four channels 326. Each of channels 326 extends from input 320 to a respective one of four rectangular exit through slots 328 (FIG. 15). Thus, each of channels 326 places a respective one of input sections 324 into fluid communication with a respective one of exit through slots 328.

The four rectangular exit through slots 328 may be conjointly referred to as a divided rectangular output 329 of waveguide 310. Rectangular output 329 is divided into four equally-sized and evenly-spaced slots 328 arranged in a matrix of two rows and two columns.

Each of channels 326 is partially defined by two adjacent inner walls 322. Walls 322 are radially-oriented at input 320, and are oriented in a same direction at output 329. Each of channels 326 is also partially defined by a respective one of four twistingly rectangular inner walls 330. Each of channels 326 is further partially defined by a respective substantially rectangular outer wall 338 that is on an inner surface of an outer boundary wall 340. Other features of waveguide 310 are substantially similar to those of waveguide 110, and thus are not described herein in order to avoid needless repetition. The output of waveguide 210 may be mated to the input of waveguide 310, just as the output of waveguide 10 is mated to the input of waveguide 110 in FIG. 10.

Figure 16:
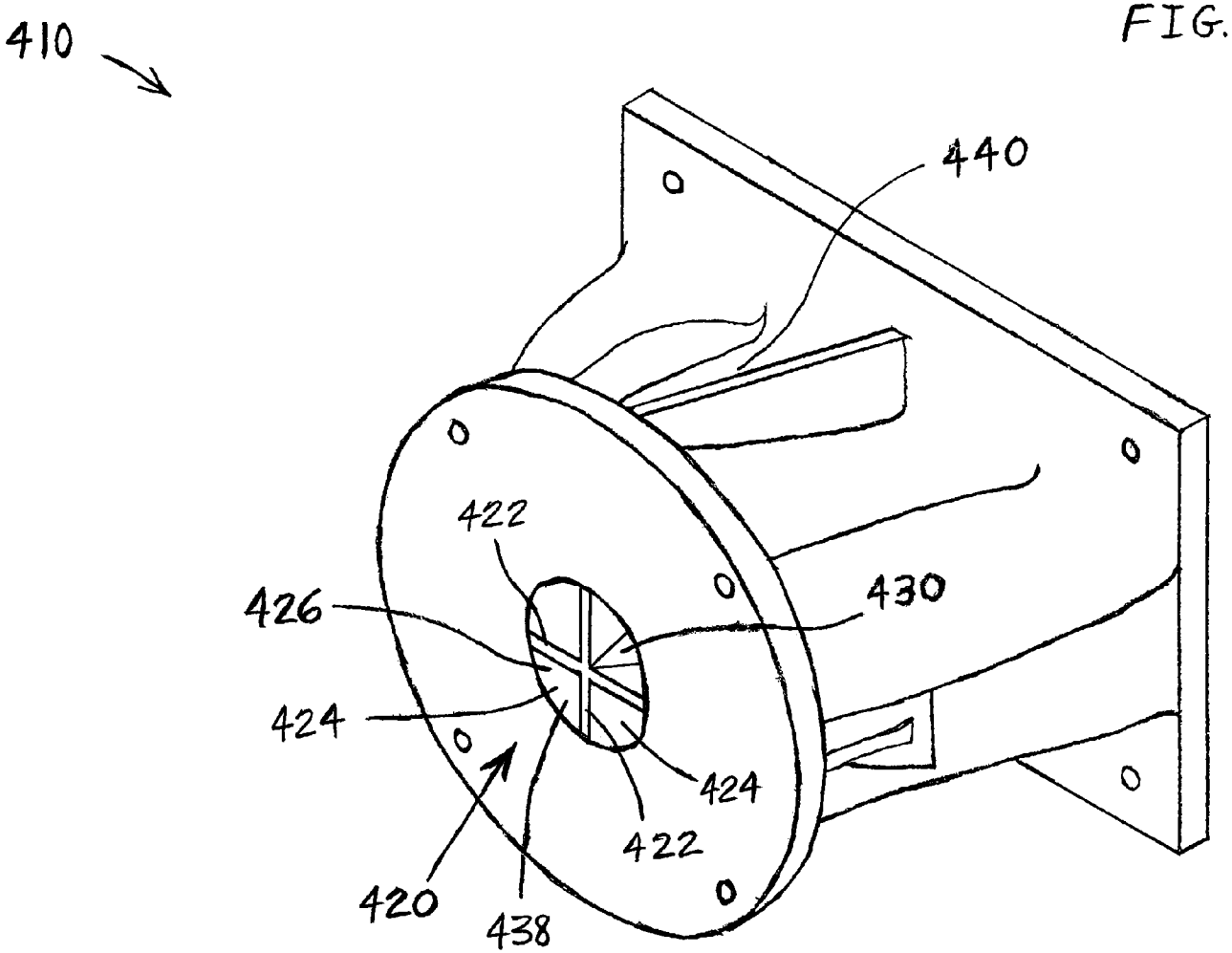
FIG. 16 is a perspective view from the input side of a further embodiment of an acoustic waveguide of the present invention having a circular divided input.
Figure 17:
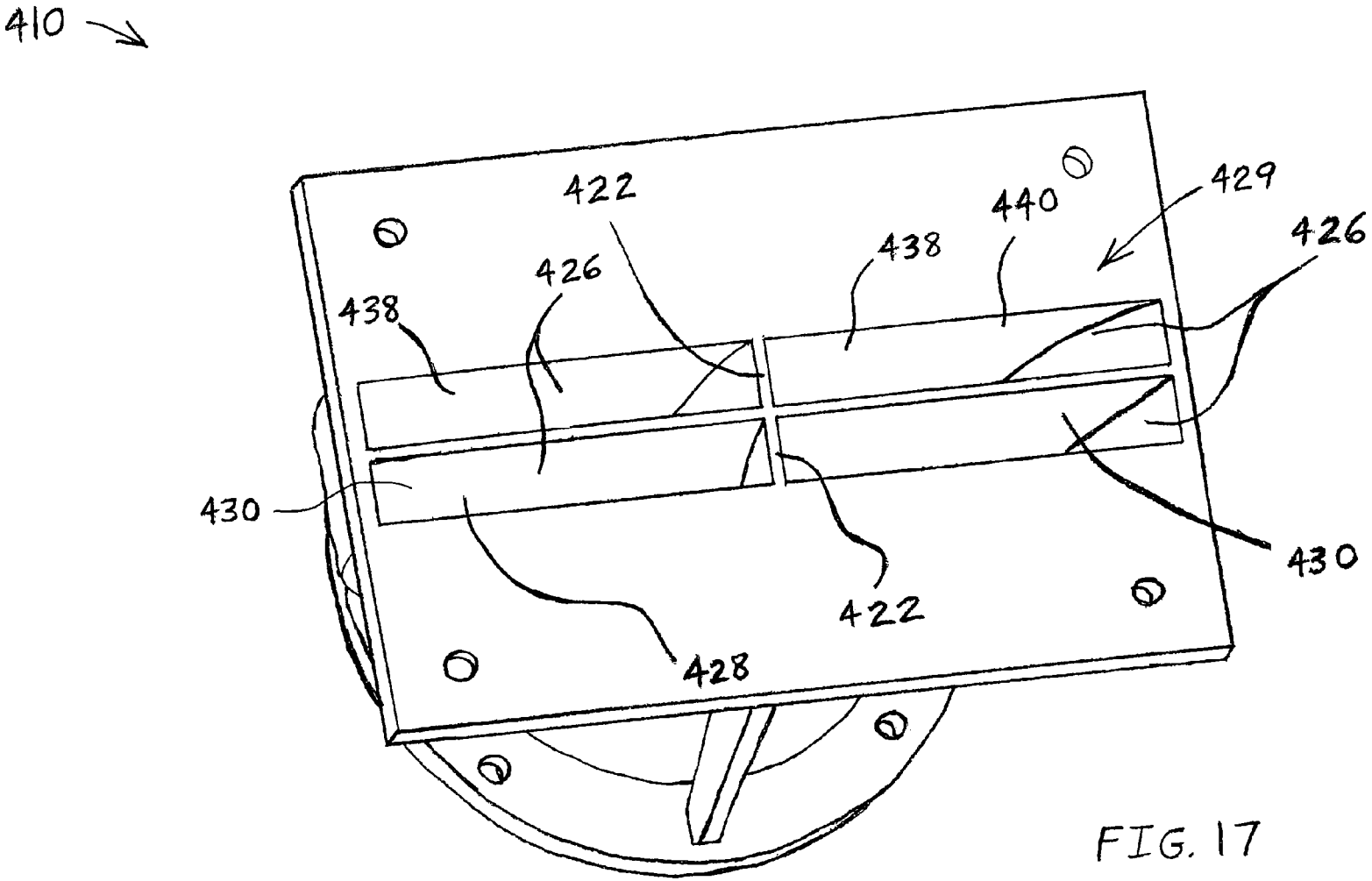
FIG. 17 is a perspective view from the output side of the acoustic waveguide of FIG. 16 having a divided rectangular output.

In the embodiments of FIGS. 1-15, two waveguides are used in succession to transform an input wave, regardless of its shape, into a rectangular planar wave. However, it is also possible to use a single waveguide to achieve this transformation within the scope of the invention. For example, in FIG. 16, there is shown a further embodiment of an acoustic transformer or waveguide 410 of the present invention including a circular divided input 420 in the form of a through hole divided by radially-oriented inner walls 422 into four equally-sized, pie-shaped entrance slots 424. Each of slots 424 leads into a respective one of four channels 426. Each of channels 426 extends from input 420 to a respective one of four rectangular exit through slots 428 (FIG. 17). Thus, each of channels 426 places a respective one of entrance slots 424 into fluid communication with a respective one of exit through slots 428.

The four rectangular exit through slots 428 may be conjointly referred to as a divided rectangular output 429 of waveguide 410. Rectangular output 429 is divided into four equally-sized and evenly-spaced slots 428 arranged in a matrix of two rows and two columns.

Each of channels 426 is partially defined by two adjacent inner walls 422. Walls 422 are radially-oriented at input 420, and are oriented in a same direction at output 429. Each of channels 426 is also partially defined by a respective one of four twistingly triangular inner walls 430. Each of channels 426 is further partially defined by a respective substantially rectangular outer wall 438 that is on an inner surface of an outer boundary wall 440. Other features of waveguide 410 are substantially similar to those of waveguides 210 and 310, and thus are not described herein in order to avoid needless repetition.

As insured by the symmetry of waveguide 410, each of the four acoustic paths 426 has an equal rate of expansion as well as an equal acoustic impedance.

Figure 18:
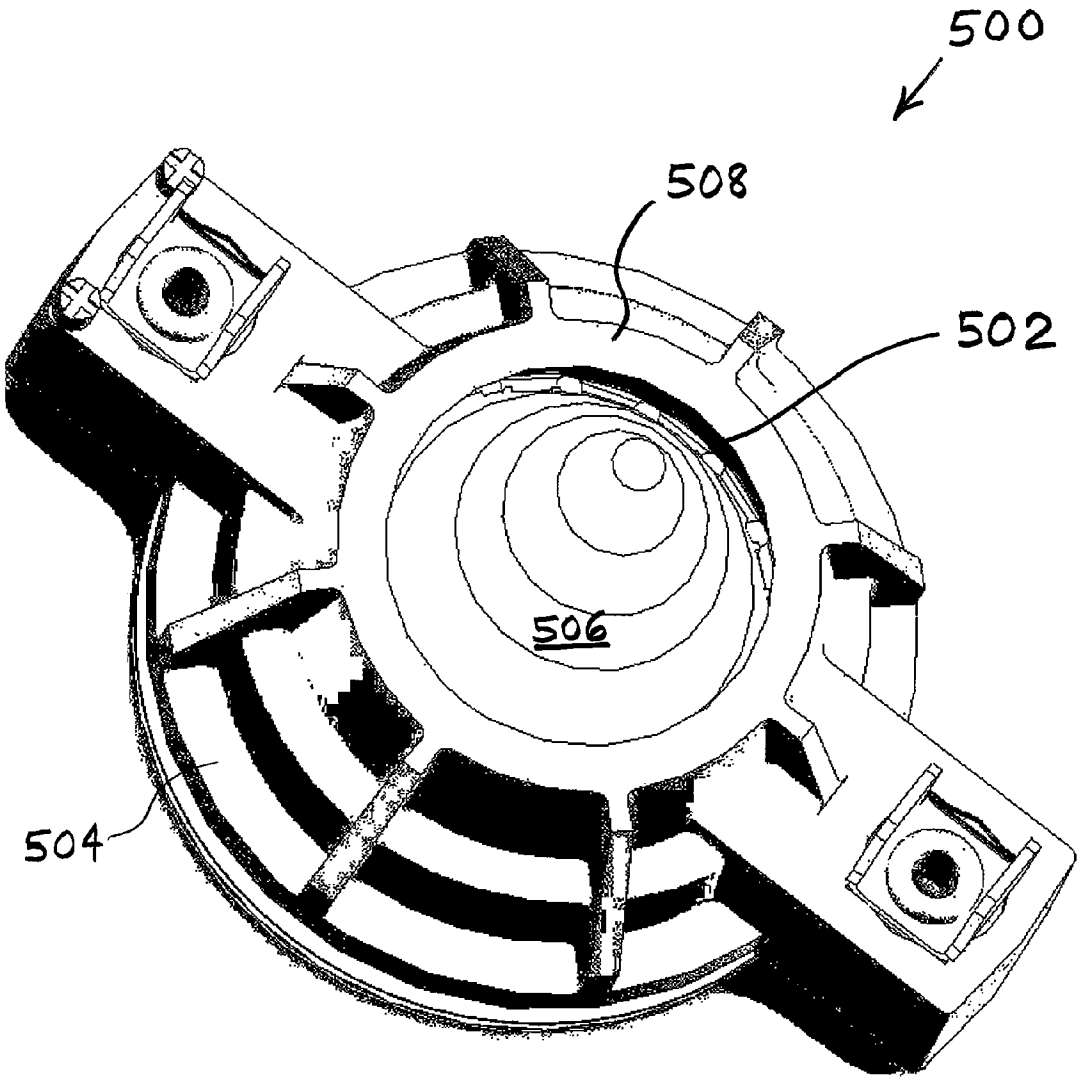
FIG. 18 is a perspective view from the output side of a compression driver that has an annular ring acoustic output suitable for matching with the divided annular ring input of the acoustic waveguide of FIG. 14.

Illustrated in FIG. 18 is a compression driver 500 that has an annular ring acoustic output 502 suitable for matching with the divided annular ring input 320 of acoustic waveguide 310 of FIG. 14. Output 502 may be defined between an annular output housing 504 and a frusto-conical portion 506. In the embodiment of FIG. 18, the tapered end of portion 506 extends past an annular, planar outer face 508 of housing 504 such that the tapered end of portion 506 may be received within a conical recess 342 of waveguide 310.

Figure 19:
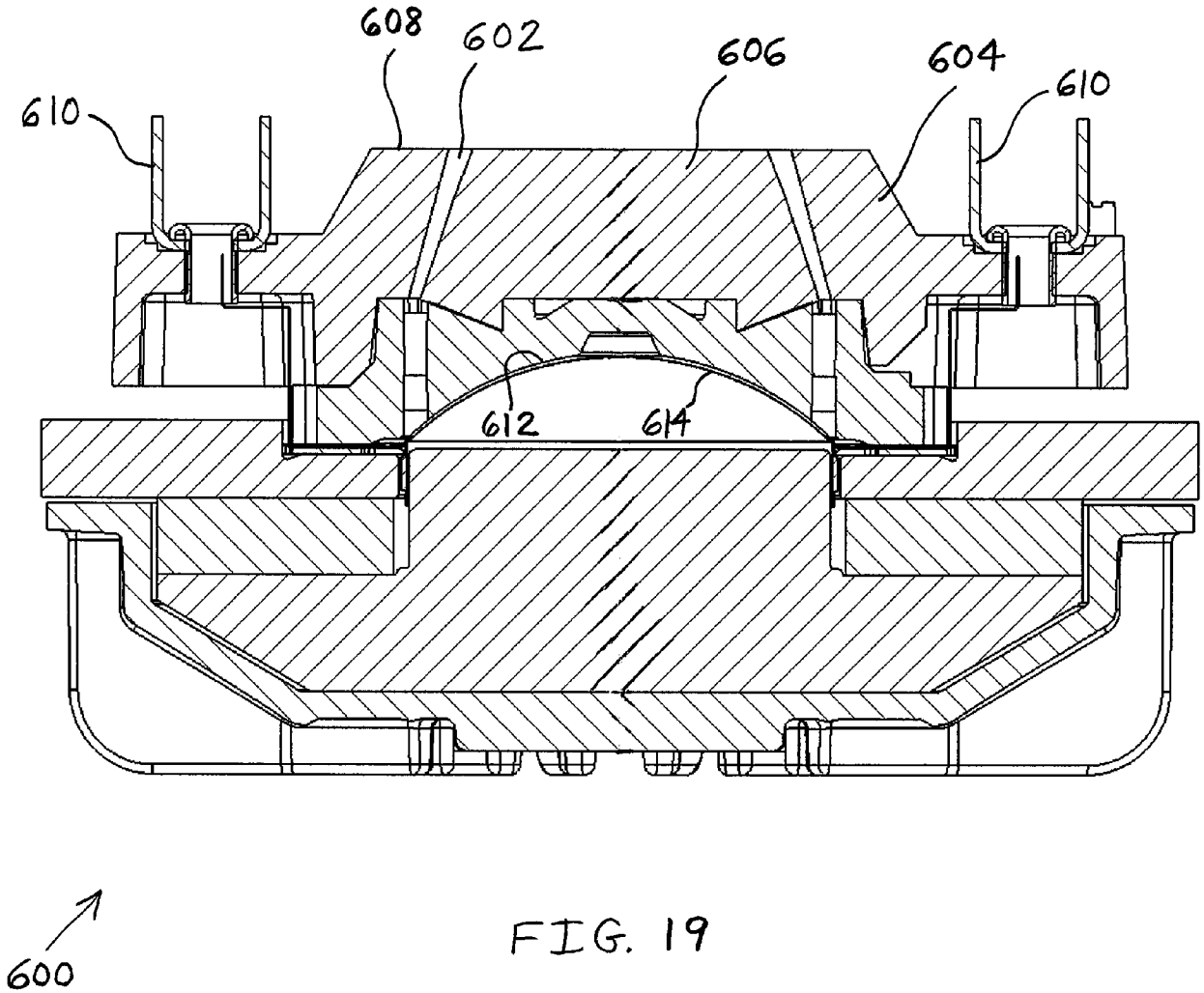
FIG. 19 is a side sectional view of another embodiment of a compression driver that has an annular ring acoustic output suitable for matching with the divided annular ring input of the acoustic waveguide of FIG. 14.

In the alternative embodiment of FIG. 19, compression driver 600 also has an annular ring acoustic output 602 suitable for matching with the divided annular ring input 320 of acoustic waveguide 310 of FIG. 14. Output 602 may be defined between an annular output housing 604 and a frusto-conical portion 606. In contrast to the embodiment of FIG. 18, the tapered end of portion 606 is flush with an annular outer face 608 of housing 604. Thus, when used in conjunction with the embodiment of FIG. 19, waveguide 310 need not include a conical recess 342. That is, recess 342 may be "filled in." In other respects, drivers 500 and 600 may be substantially identical.

Driver 600 may include U-shaped terminals 610 through which electrical inputs to a voice coil (not shown) within a magnetic gap (not shown) may be entered. Driver 600 may further include a frusto-spherical phase plug entrance 612 disposed closely adjacent and parallel to a frusto-spherical titanium dome 614.

Figure 6:
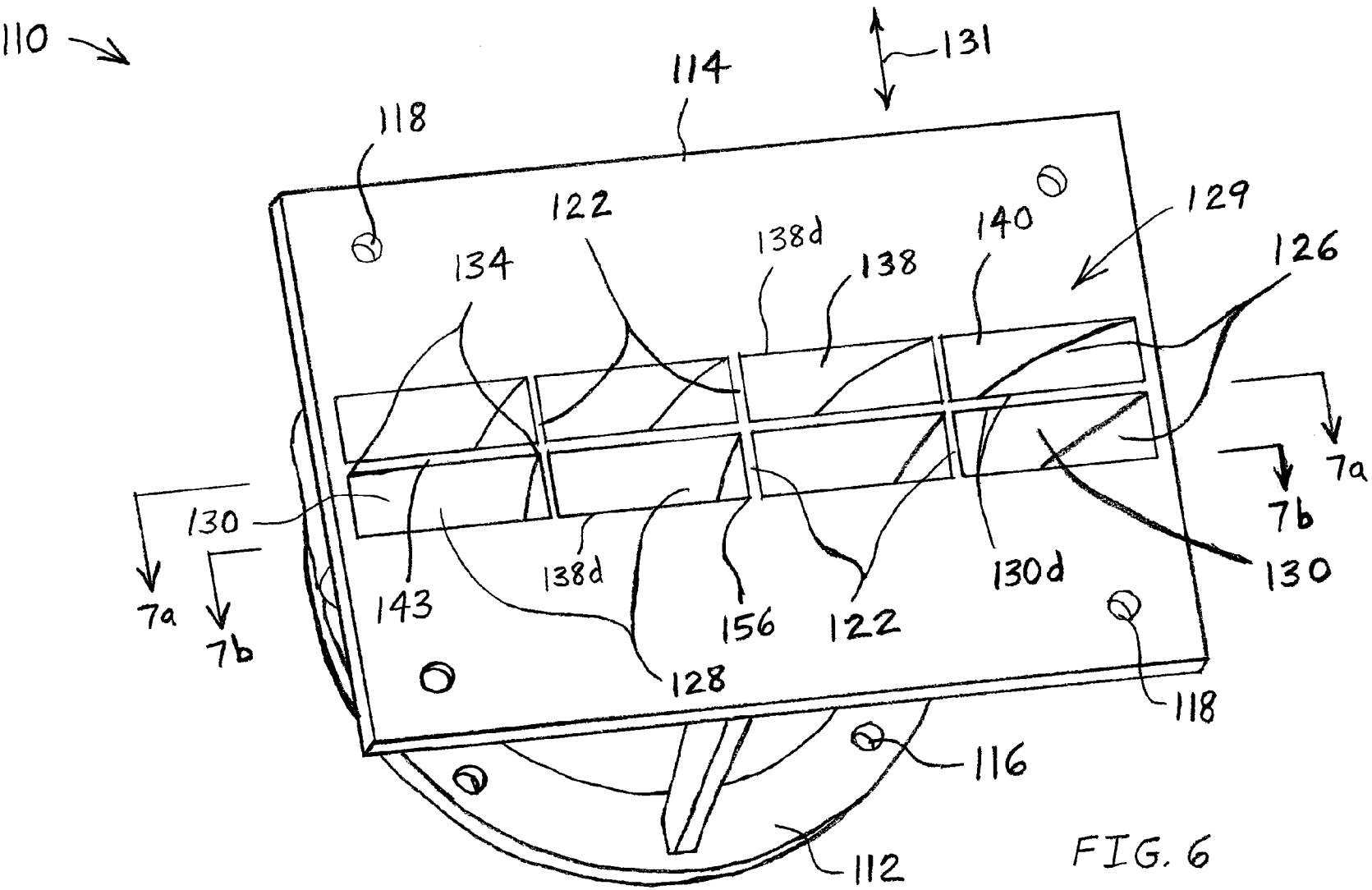
FIG. 6 is a perspective view from the output side of the acoustic waveguide of FIG. 5 having a divided rectangular output.
Figure 20:
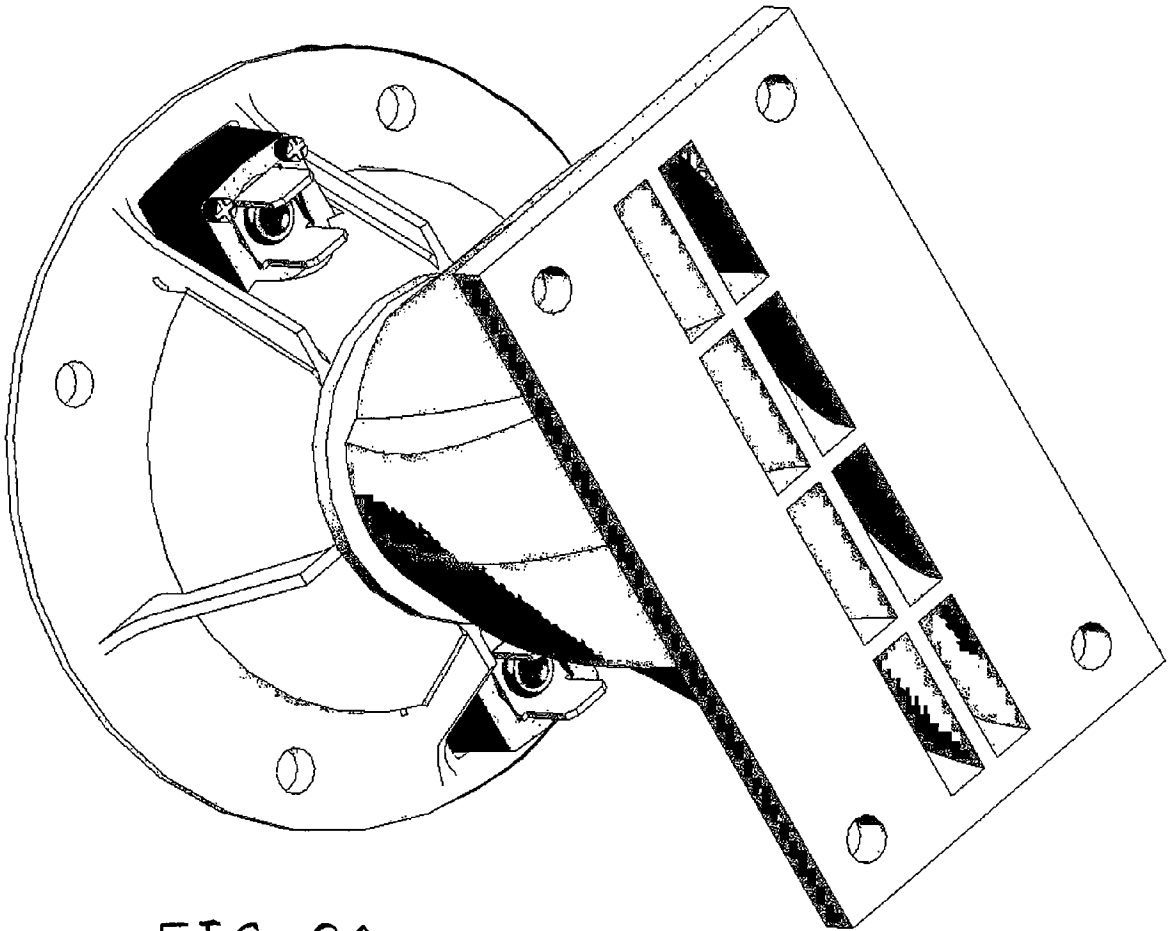
FIG. 20 is a perspective view of the compression driver of FIG. 18 affixed to the acoustic waveguide of FIG. 6.

FIG. 20 illustrates a compression driver, similar to compression driver 500 of FIG. 18, affixed to an acoustic waveguide that is similar to acoustic waveguide 110 of FIG. 6.

Figure 21:
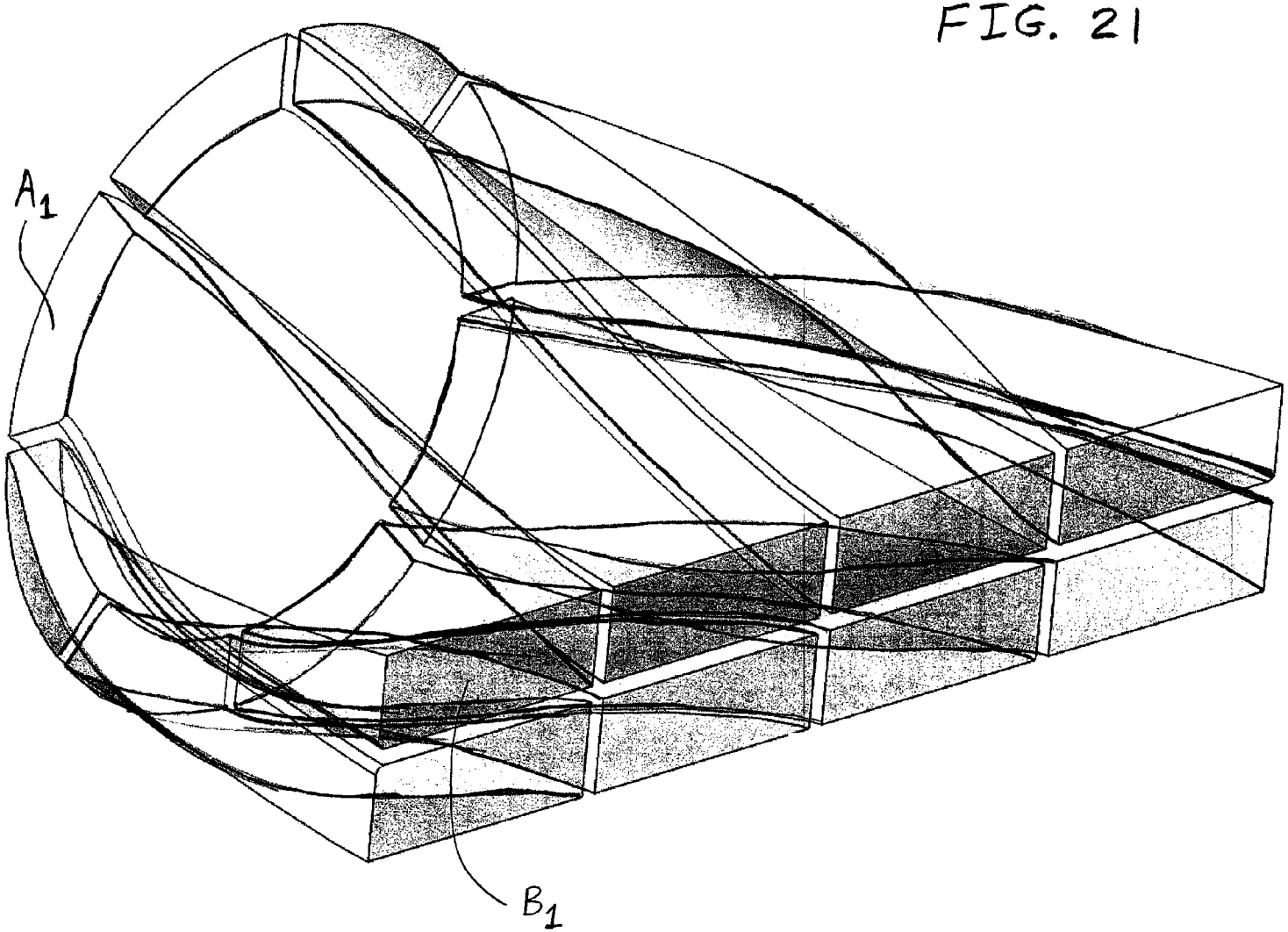
FIG. 21 is a perspective view diagramming the acoustic paths of the acoustic waveguide of FIG. 6.

FIG. 21 is a perspective view diagramming the acoustic paths 126 of the acoustic waveguide of FIG. 6, with each of the paths having an equal length. These paths each map an input area $A_n$ onto an output area $B_n$, where n denotes the path number for a waveguide with a total of N paths. An example input area $A_1$ and output area $B_1$ are shown in FIG. 21. The length of the path connecting input area $A_n$ and output area $B_n$ may be denoted as $l_n$. Each mapping may occur through its own function $f_n$. In this case, $f_1$ and $f_2$ may be mirrored in the horizontal and vertical planes to produce a linear wavefront at the device exit. In addition, the rate at which a mapping function $f_n$ maps $A_n \rightarrow B_n$ over the length $l_n$ may describe and/or define an acoustic impedance $Z_n$ of each path. These parameters $A_n$, $B_n$, $l_n$, and $Z_n$ may be selected based on what application the waveguide is being used for and what wavefront geometry is required for that application.

In general, the waveguide of the invention may be able to transform a substantially time coherent wavefront of even power distribution at the annular input into a variety of wavefronts at the device output. Segmenting or isolating the acoustic passages that link or interconnect the input and output may serve to restrict the acoustic wave from propagating along any path other than the path that it is intended to propagate along. The parameters $A_n$ $B_n$, $l_n$, and $Z_n$ may be individually selected for each path to thereby create convex, concave or planar exit wavefront geometries in one plane while acoustic pressure gradient symmetry is maintained in another plane.

A particularly useful application for the invention may be in the field of arrayable loudspeaker systems wherein a planar wave exiting wavefront is required. The present invention may achieve this condition by setting $A_n$, $B_n$, $l_n$ and $Z_n$ equal for every path. This may produce, at the waveguide output, a planar wave with symmetric pressure gradients in the horizontal plane and line source behavior in the vertical plane.

Figure 22:
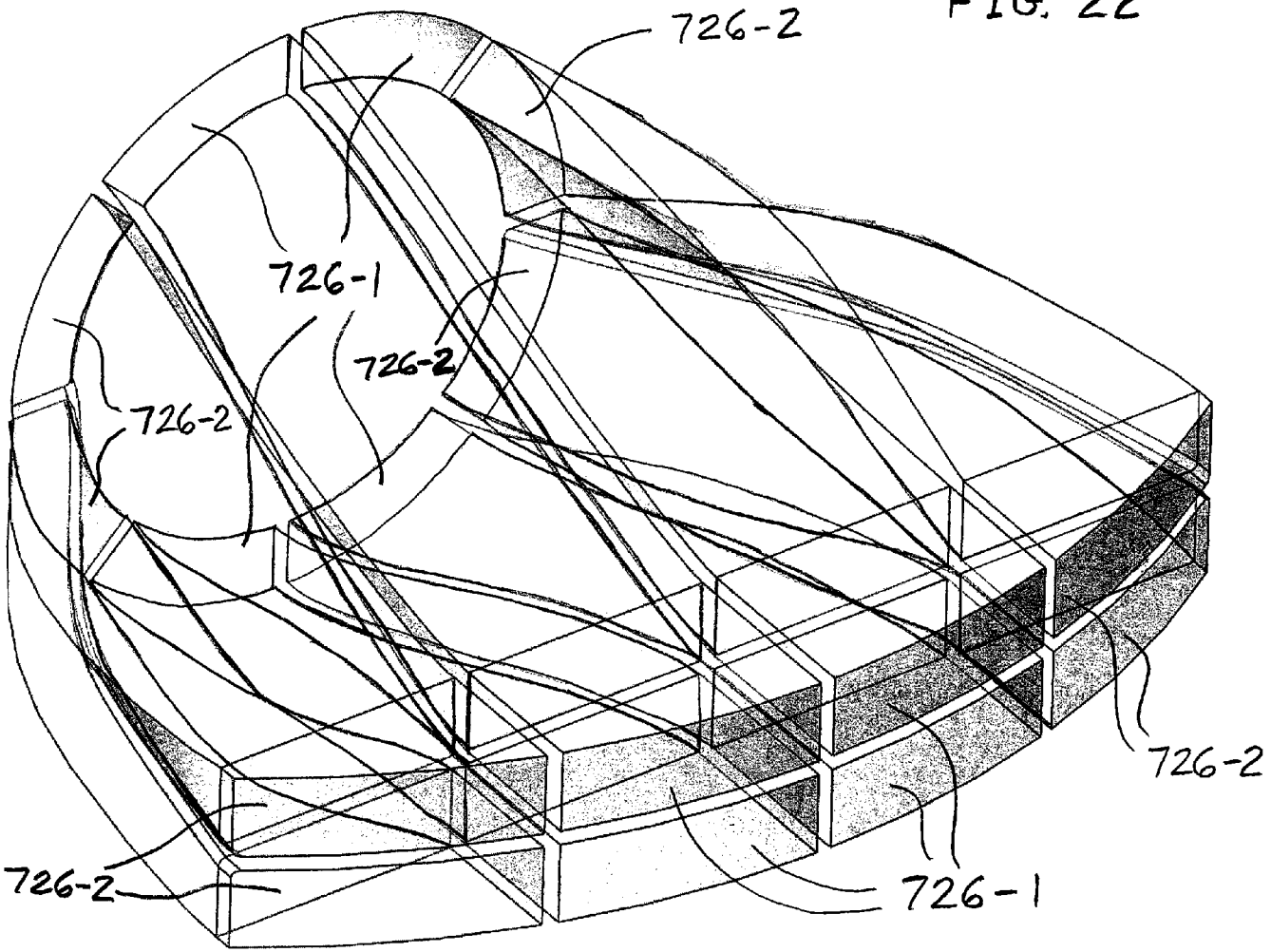
FIG. 22 is a perspective view diagramming the acoustic paths of another embodiment of an acoustic waveguide of the present invention.

FIG. 22 is a perspective view diagramming the acoustic paths of another embodiment of an acoustic waveguide of the invention, with not all of the paths having an equal length. A curved wavefront that is symmetric vertically may be created by varying the length of each path. Acoustic paths near the center of the device are longer than those paths at the edges of the device. More particularly, the curved exit wavefronts may be created by making $A_n$, $B_n$, $l_n$ and $Z_n$ intentionally unequal in the vertical direction. For example a convex curved wave output may be constructed by making path lengths $l_n$ longer for paths 726-1 in the middle of the device than for paths 726-2 at the outside of the device. This may produce an exiting wavefront wherein the middle portion paths are delayed with respect to the outside portion paths.

In another embodiment, input area $A_n$ and output area $B_n$ may also be varied to produce a source of varying intensity. This may be accomplished by having all input areas $A_n$'s equal but having the output areas $B_n$'s unequal so that the acoustic power is evenly divided at the entrance, but unevenly dispersed at the exit. This technique may of course mean that different expansion functions are implemented for each path. A variety of mathematically useful source shapes may be realized in this way.

As can be seen in FIGS. 21-22 the walls defining the acoustic paths may be substantially S-shaped. That is, each wall may have two points of inflection. The intersection of the side walls and the inner and outer shells, as visible in FIGS. 21-22 may also be substantially S-shaped.

Figure 23A:
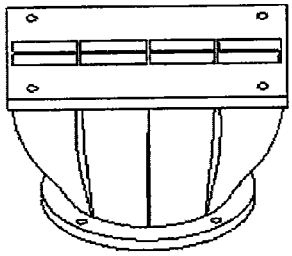
FIG. 23*a* is an output side view of an acoustic waveguide of the invention that may include the acoustic paths shown in FIG. 21.
Figure 23B:
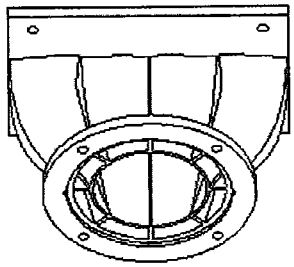
FIG. 23*b* is an input side view of the waveguide of FIG. 23*a*.
Figure 27A:
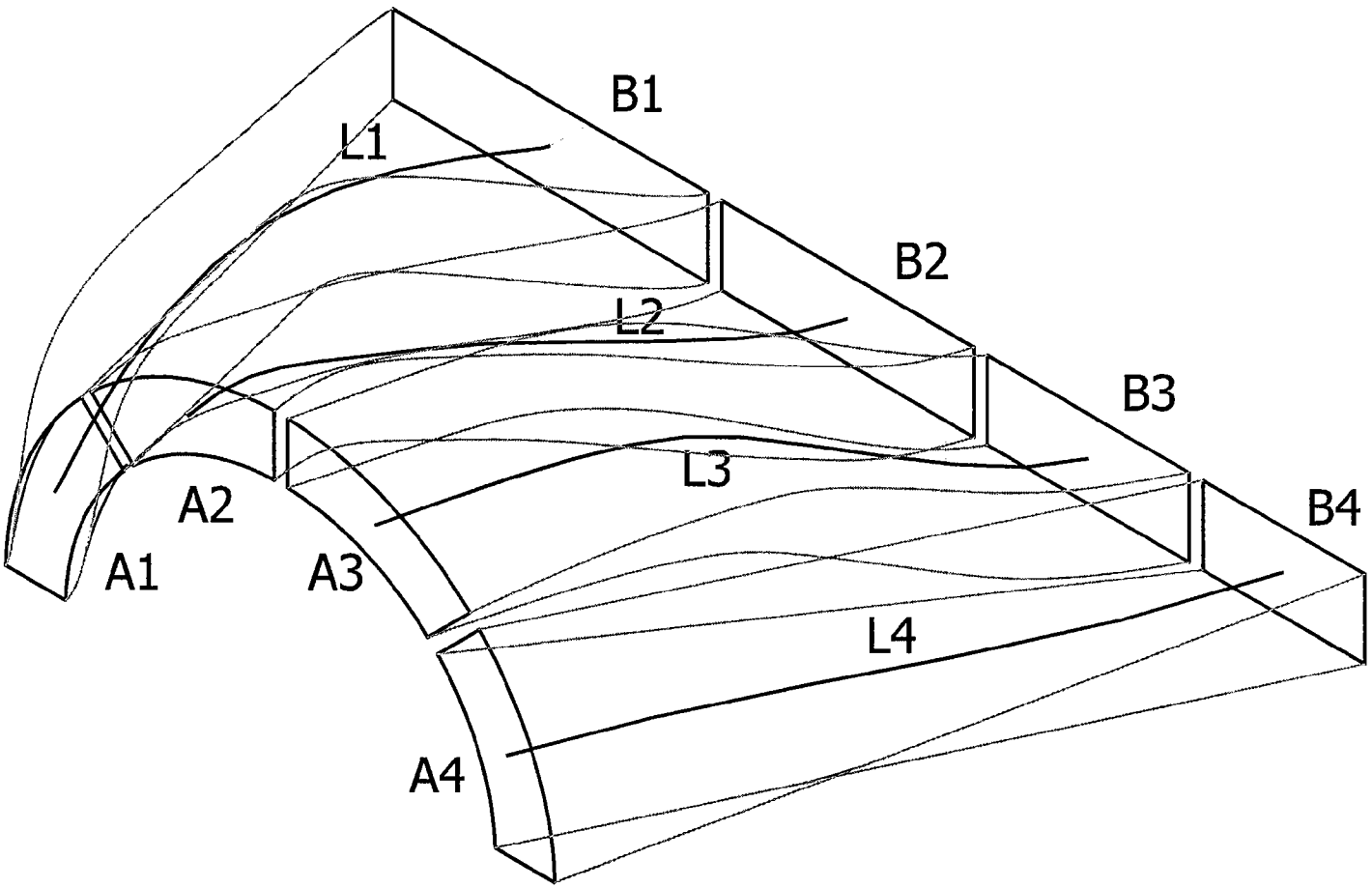
FIG. 27*a* is a perspective view diagramming the acoustic paths of another embodiment of an acoustic waveguide having a flat exit, equal path lengths, and unequal exit areas.
Figure 27B:
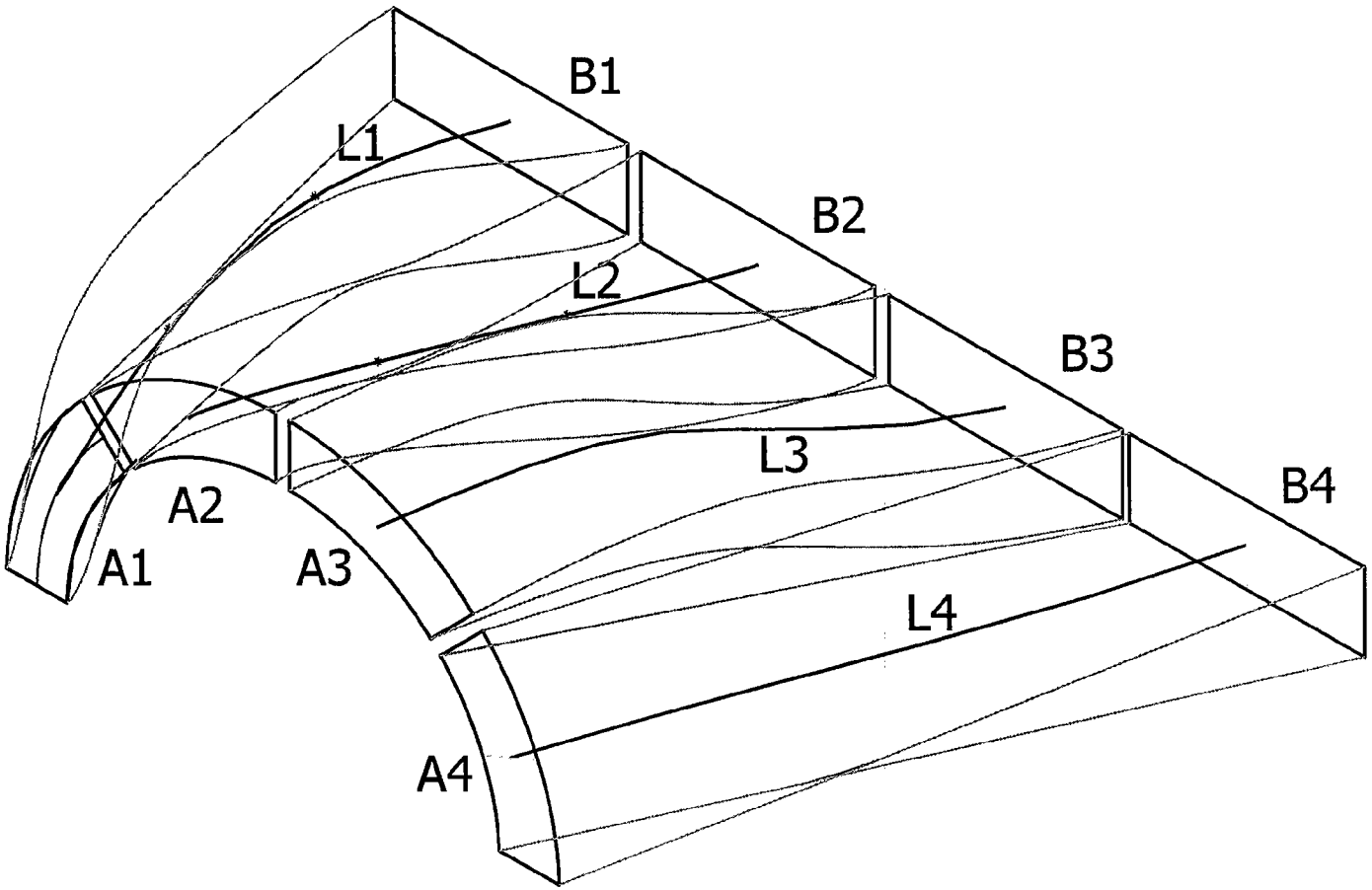
FIG. 27*b* is a perspective view diagramming the acoustic paths of another embodiment of an acoustic waveguide having a flat exit, unequal path lengths, and unequal exit areas.
Figure 28A:
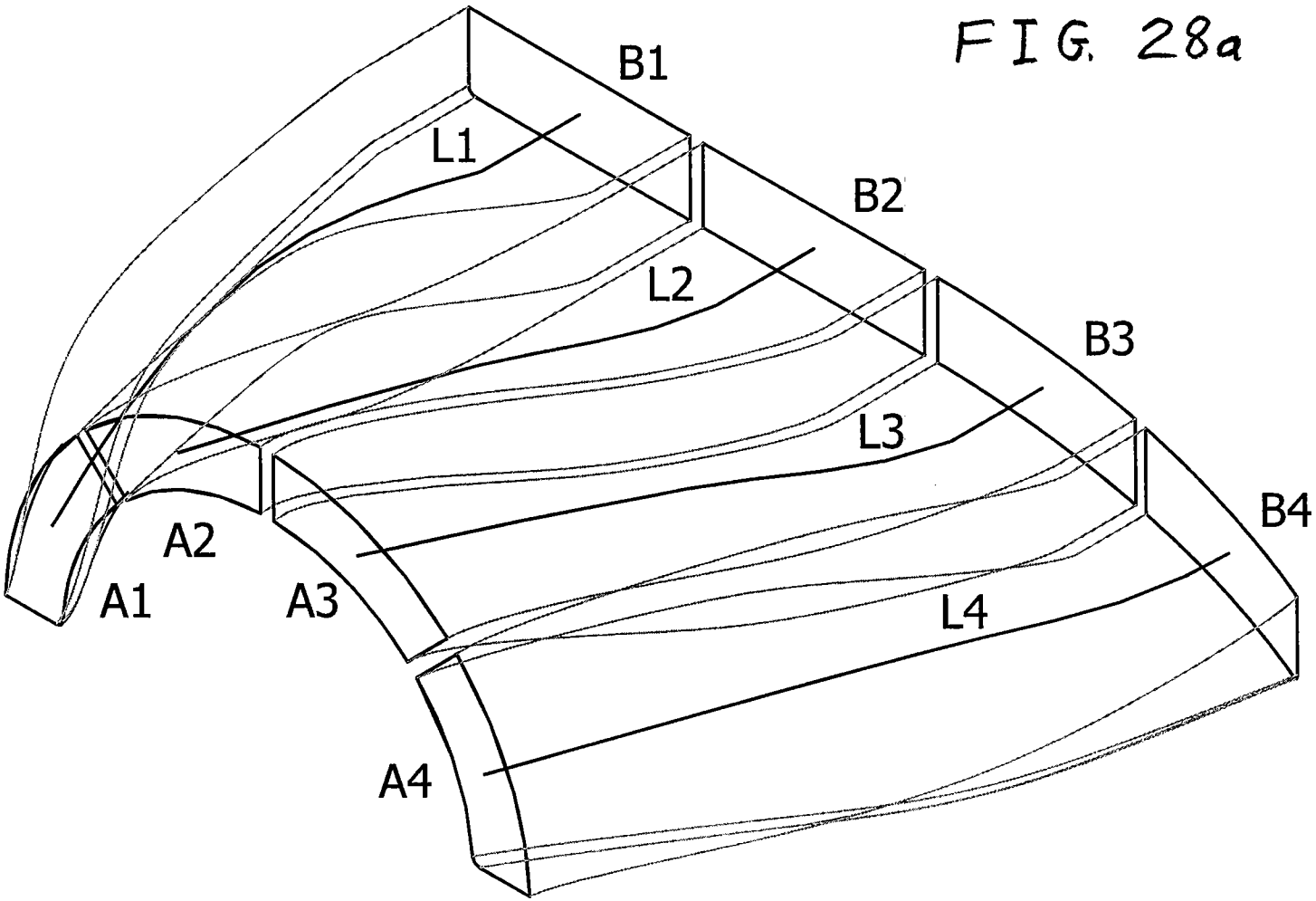
FIG. 28*a* is a perspective view diagramming the acoustic paths of another embodiment of an acoustic waveguide having a complex curved exit, unequal path lengths, and equal exit areas.
Figure 28B:
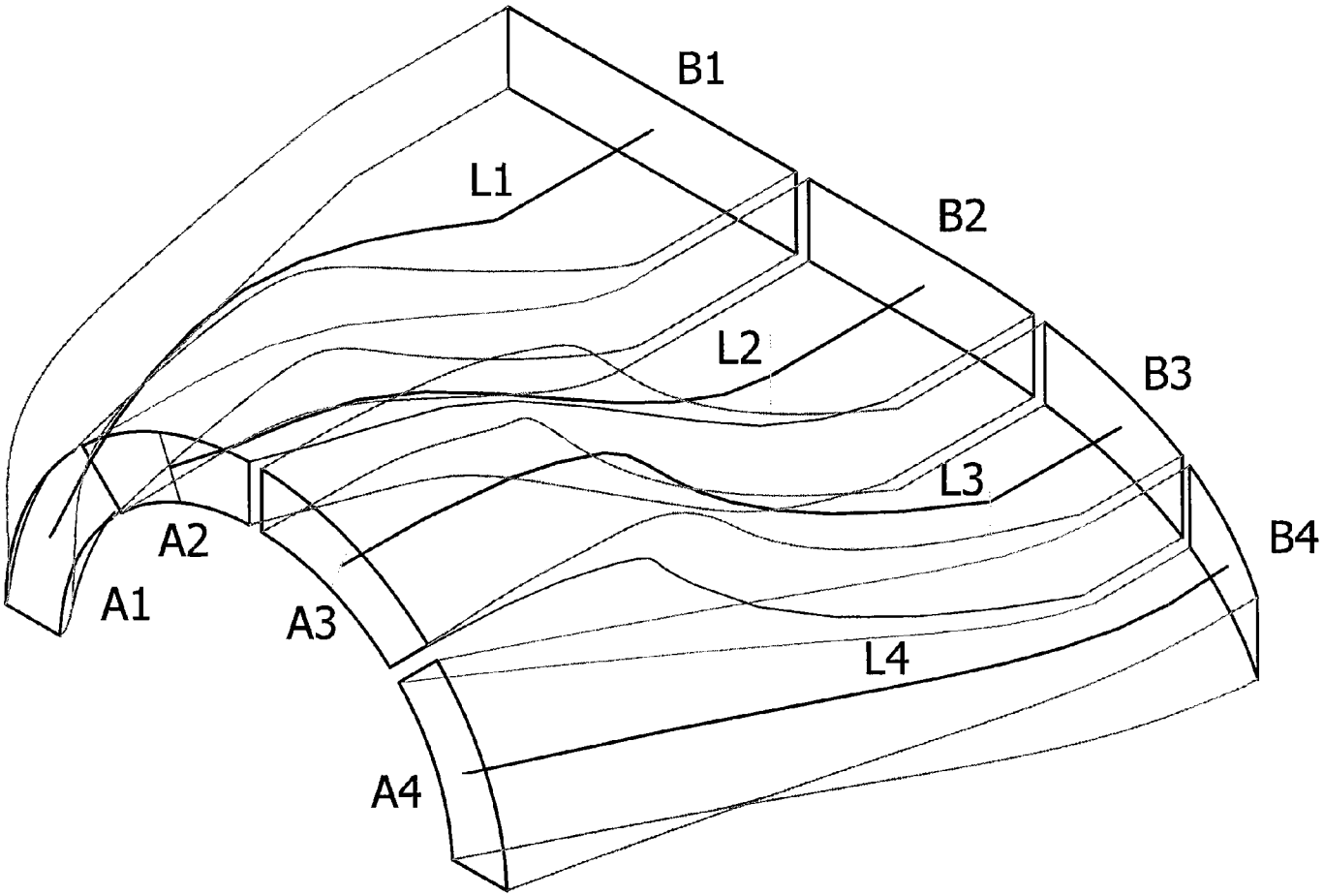
FIG. 28*b* is a perspective view diagramming the acoustic paths of another embodiment of an acoustic waveguide having a complex curved exit, equal path lengths, and unequal exit areas.
Figure 28C:
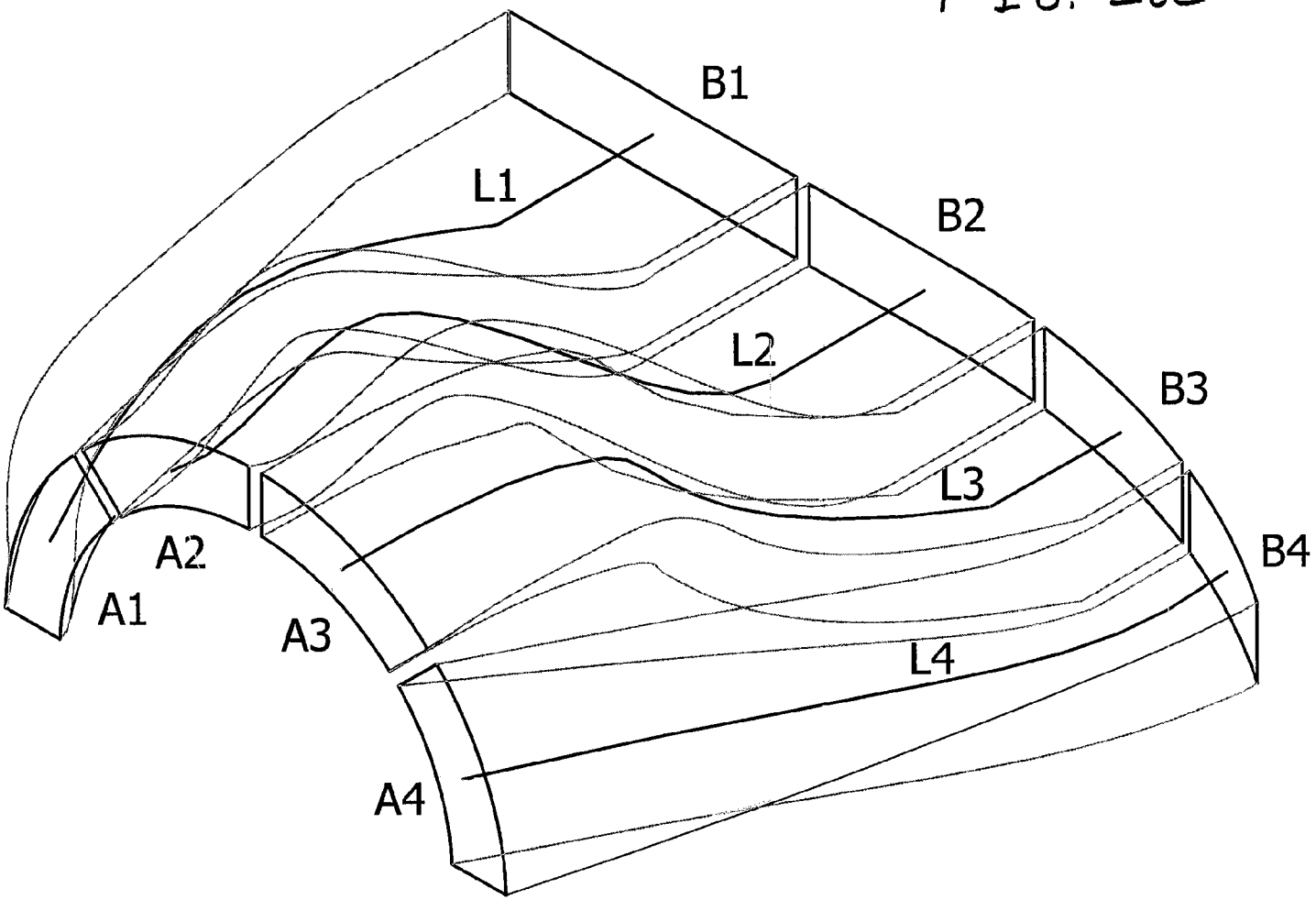
FIG. 28*c* is a perspective view diagramming the acoustic paths of another embodiment of an acoustic waveguide having a complex curved exit, unequal path lengths, and unequal exit areas.
Figure 28D:
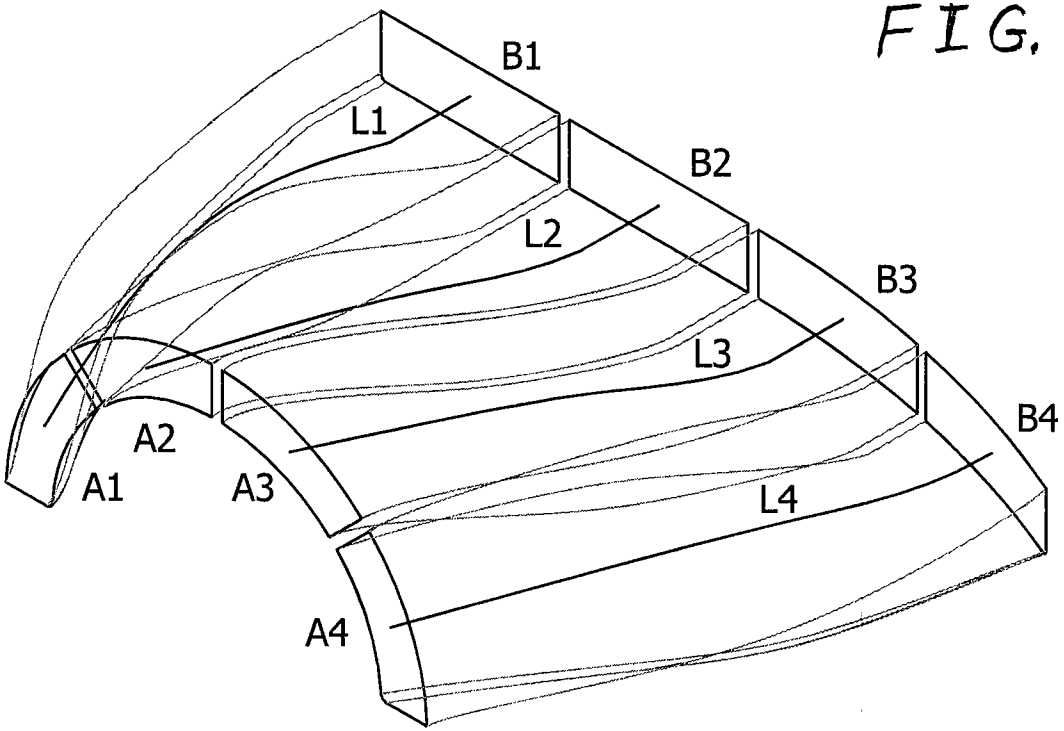
FIG. 28*d* is a perspective view diagramming the acoustic paths of another embodiment of an acoustic waveguide having a complex curved exit, equal path lengths, and equal exit areas.
Figure 29A:
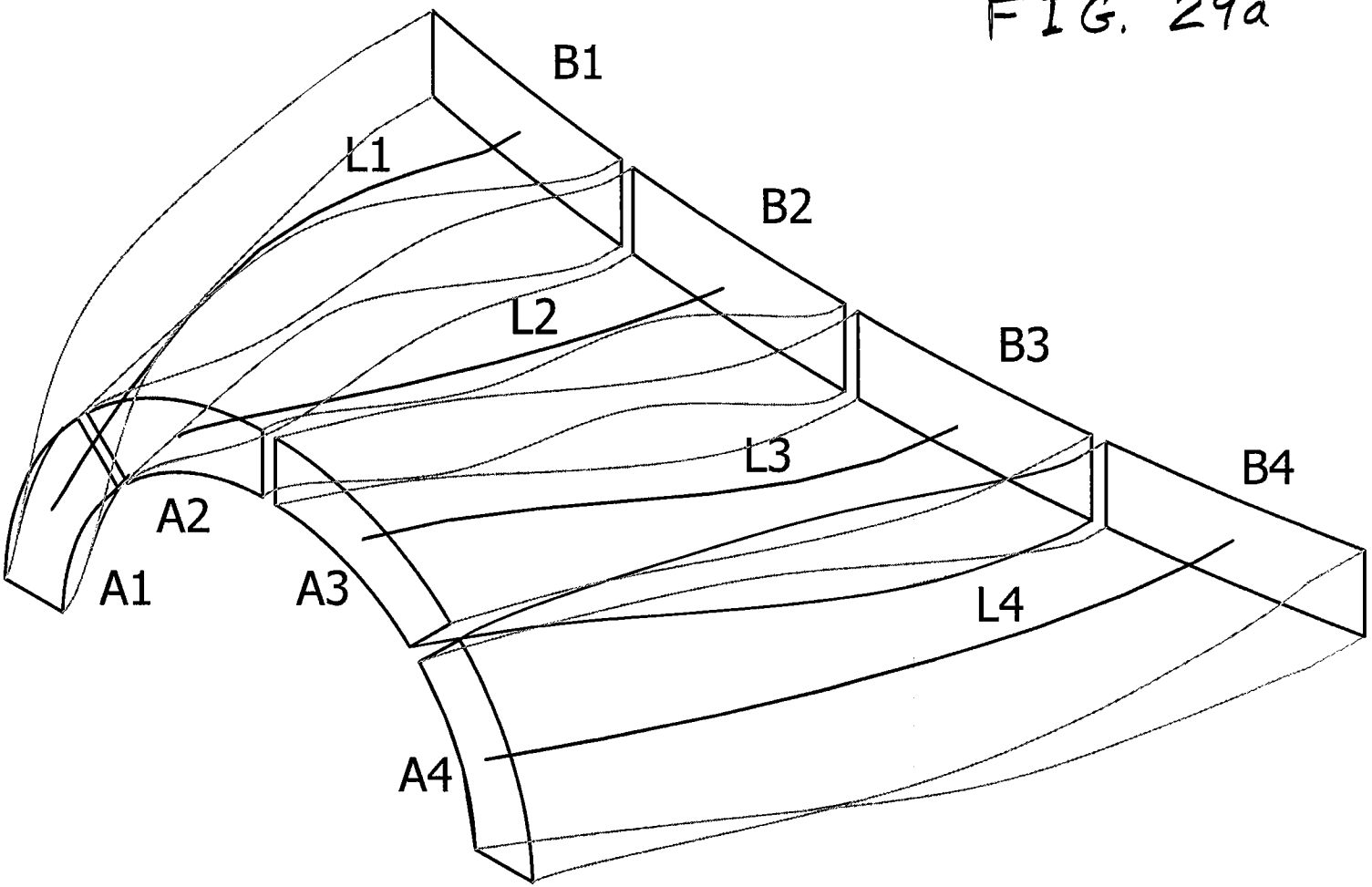
FIG. 29*a* is a perspective view diagramming the acoustic paths of another embodiment of an acoustic waveguide having a concave exit, unequal path lengths, and equal exit areas.
Figure 29B:
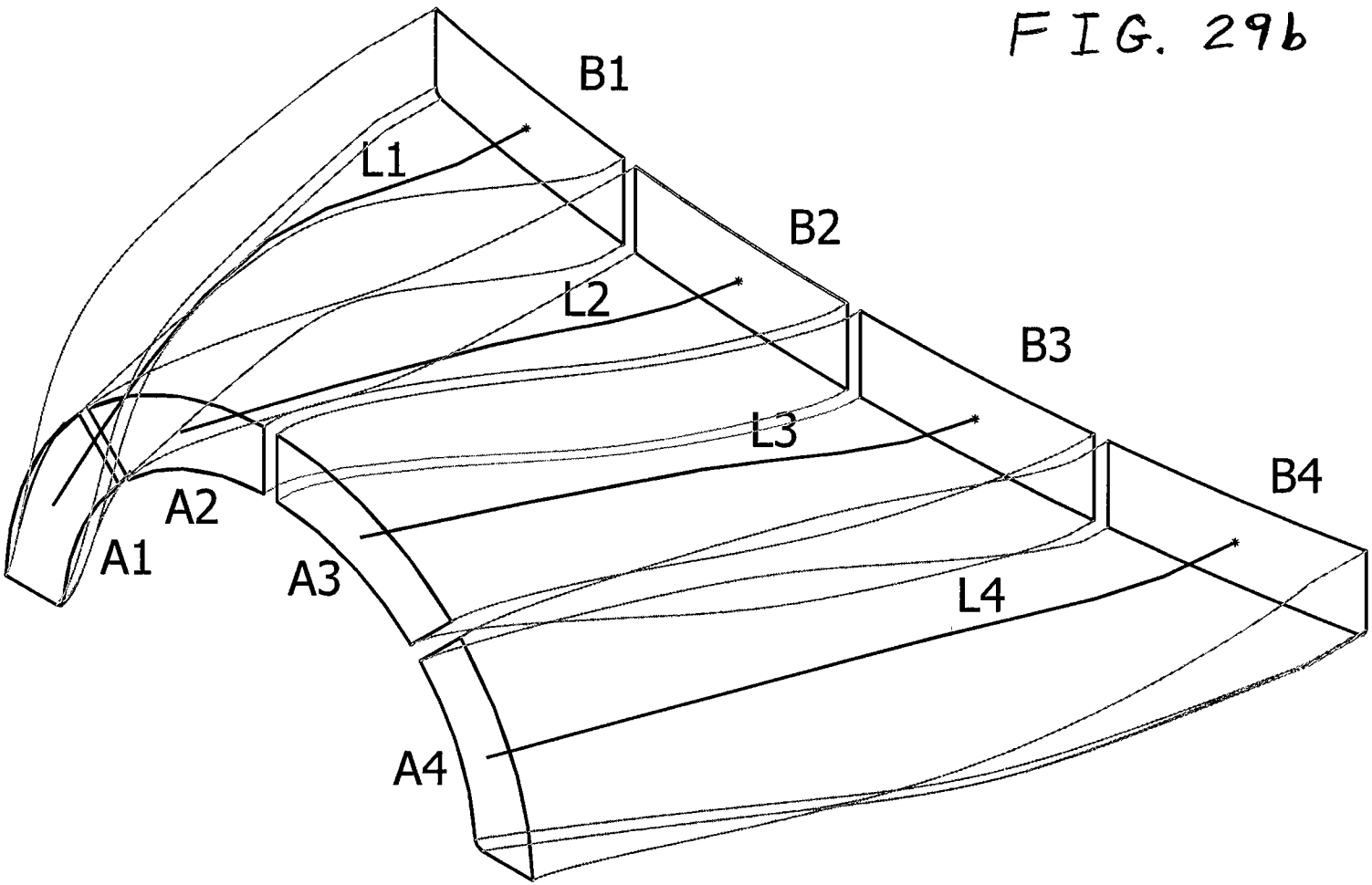
FIG. 29*b* is a perspective view diagramming the acoustic paths of another embodiment of an acoustic waveguide having a concave exit, equal path lengths, and equal exit areas.
Figure 29C:
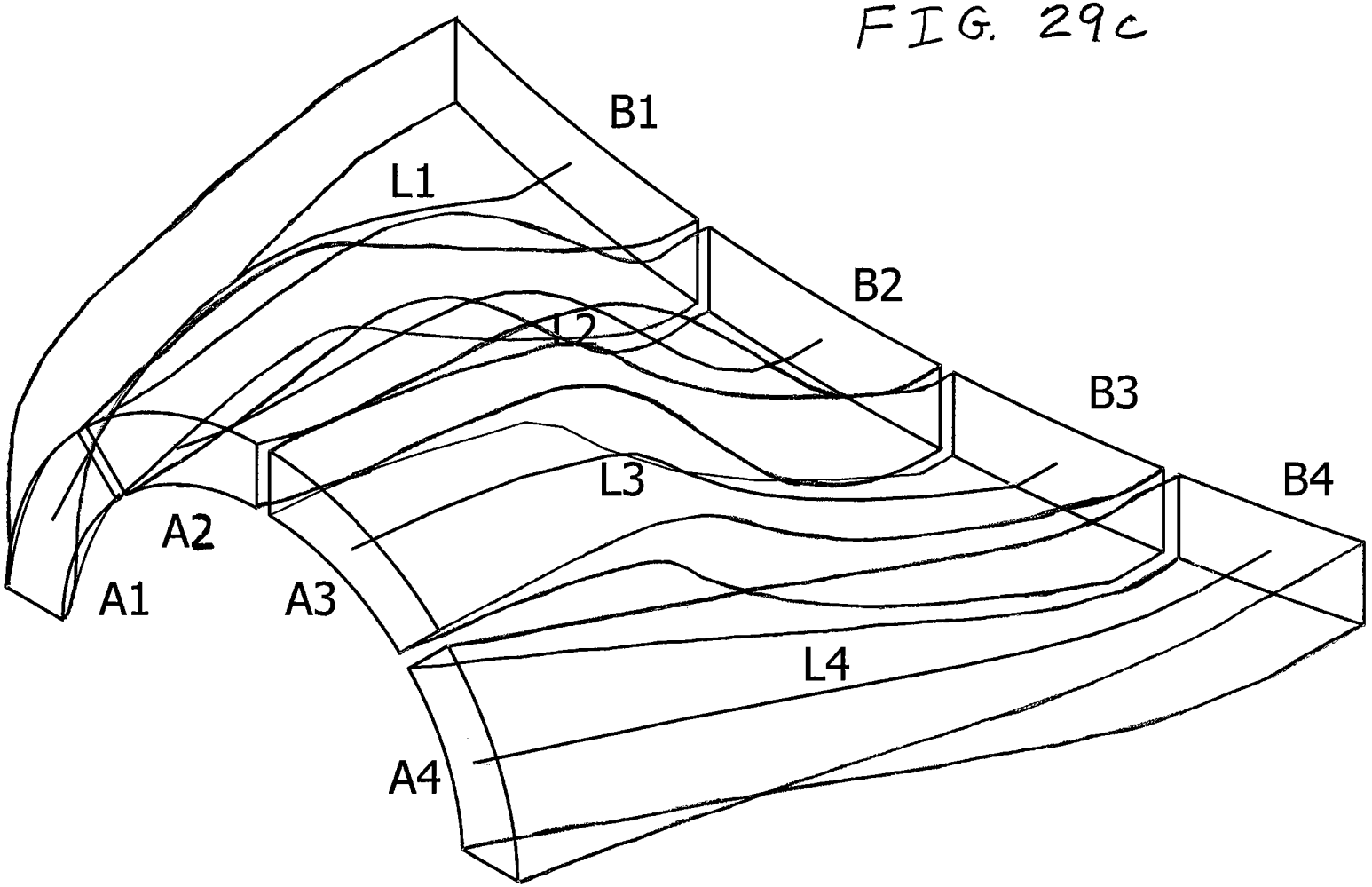
FIG. 29*c* is a perspective view diagramming the acoustic paths of another embodiment of an acoustic waveguide having a concave exit, unequal path lengths, and unequal exit areas.
Figure 29D:
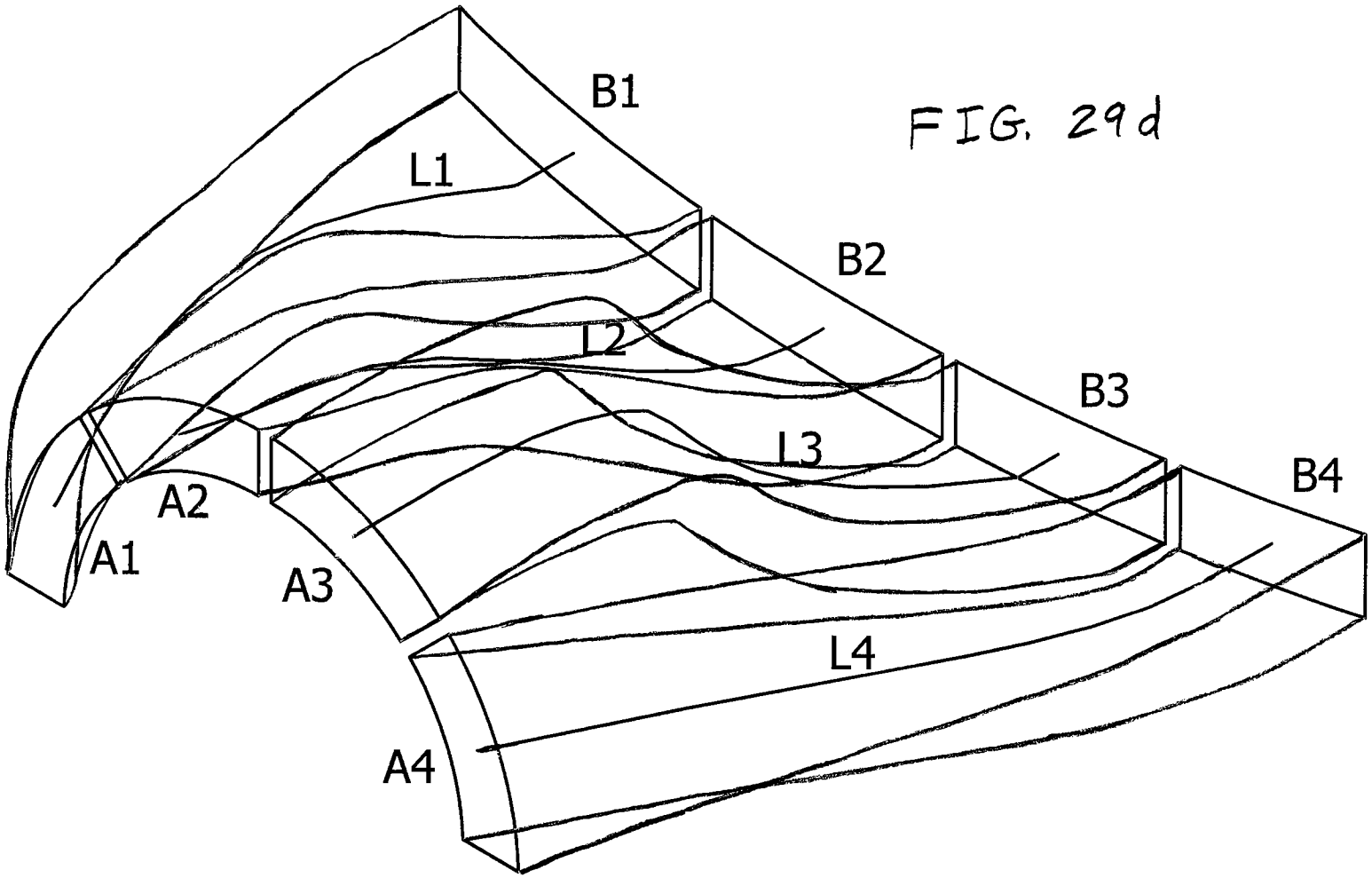
FIG. 29*d* is a perspective view diagramming the acoustic paths of another embodiment of an acoustic waveguide having a concave exit, equal path lengths, and unequal exit areas.
Figure 30A:
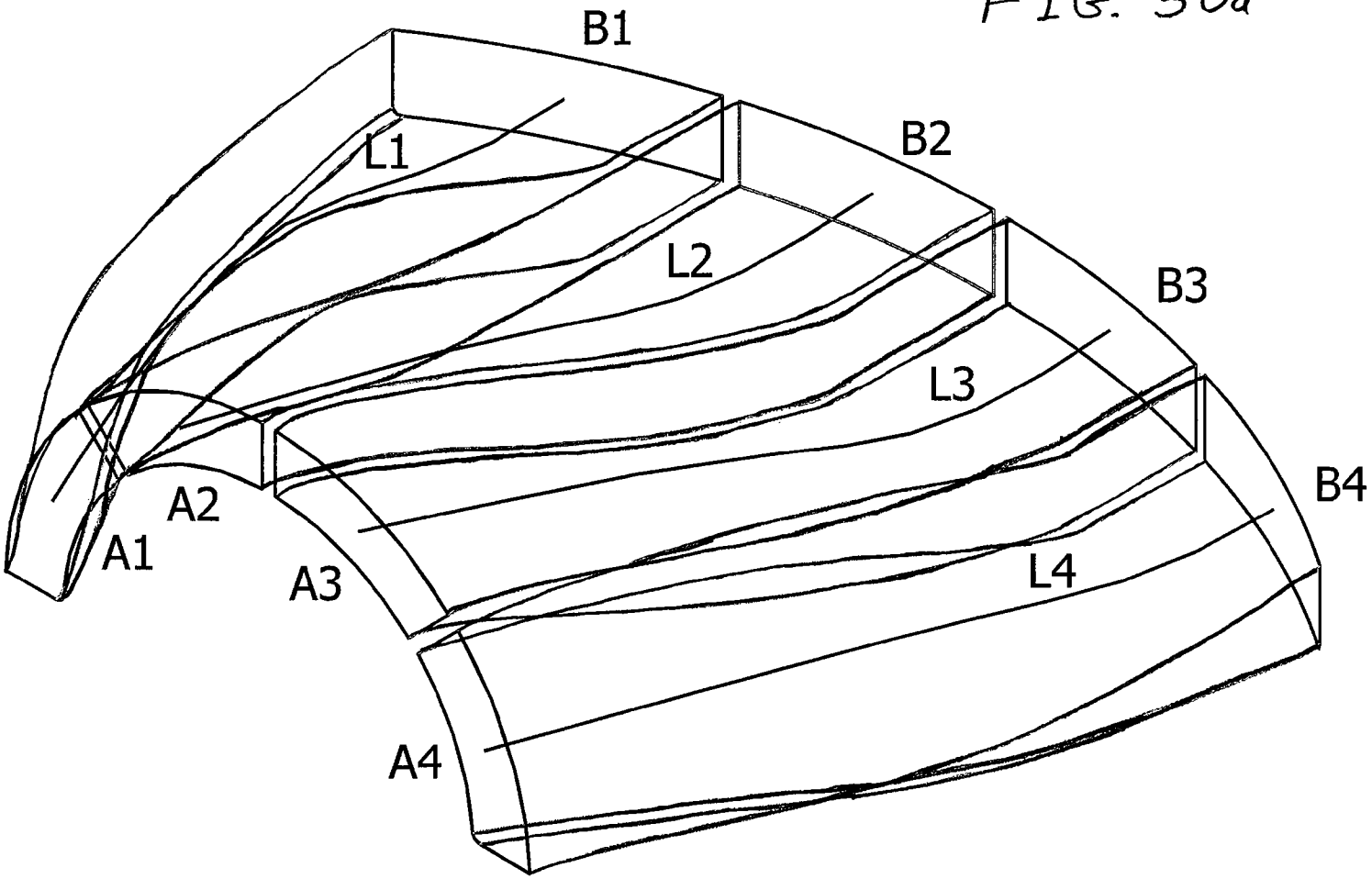
FIG. 30*a* is a perspective view diagramming the acoustic paths of another embodiment of an acoustic waveguide having a convex exit, unequal path lengths, and equal exit areas.
Figure 30B:
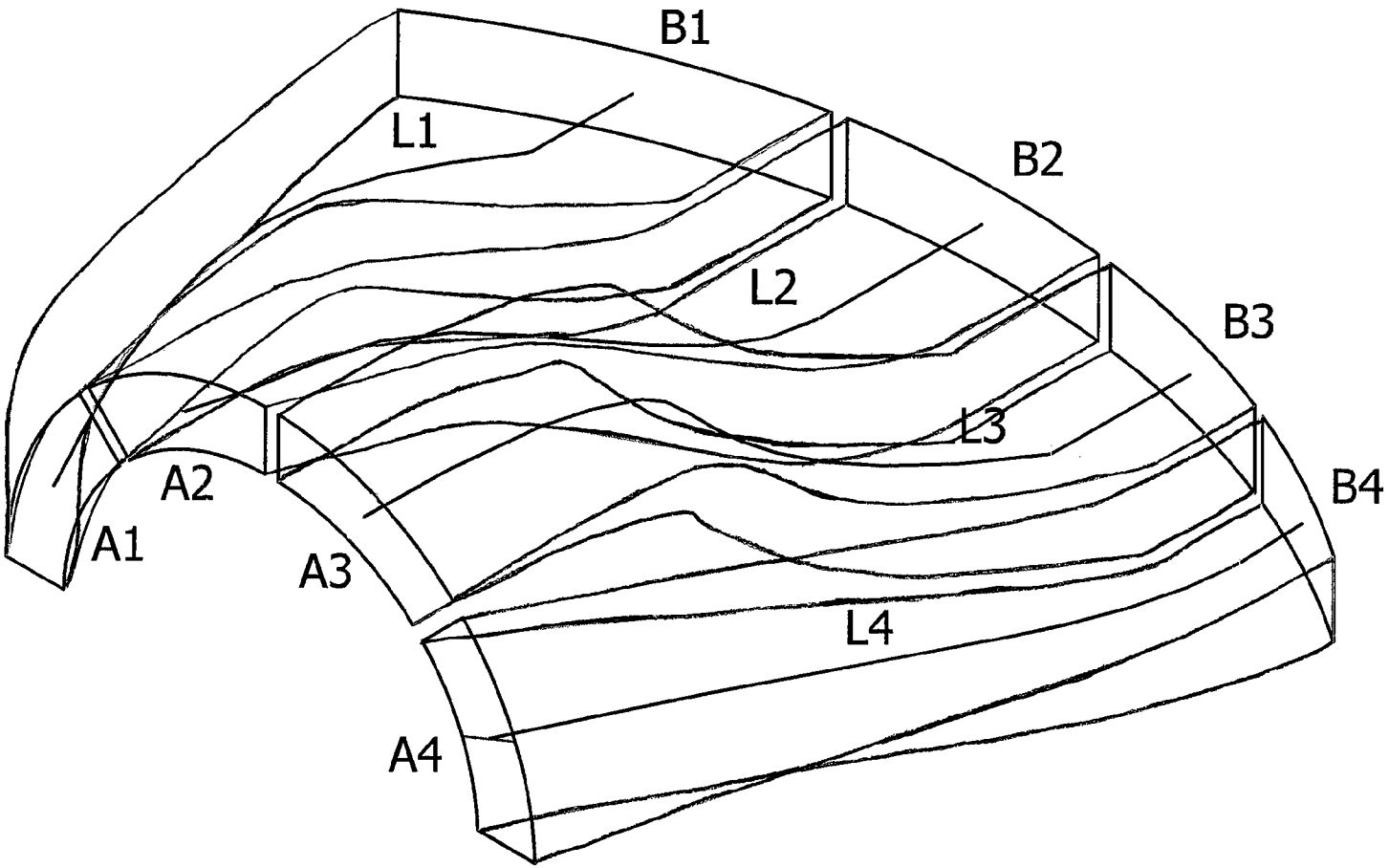
FIG. 30*b* is a perspective view diagramming the acoustic paths of another embodiment of an acoustic waveguide having a convex exit, equal path lengths, and unequal exit areas.

Illustrated in FIG. 23*a* is another acoustic waveguide of the invention that may include the acoustic paths of equal lengths and equal exit areas, as shown in FIG. 21. Thus, the paths are symmetric with respect to each of two planes that are perpendicular to each other. The input side of the waveguide of FIG. 23*a* is shown in FIG. 23*b*.

Figure 24A:
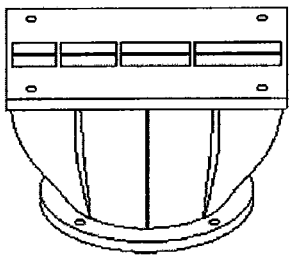
FIG. 24*a* is an output side view of another embodiment of a waveguide of the invention, similar to FIG. 23*a*, but with the acoustic paths having unequal exit areas.
Figure 24B:
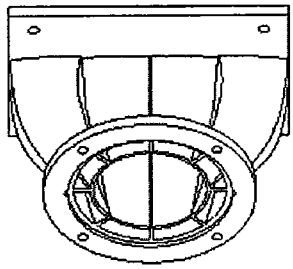
FIG. 24*b* is an input side view of the waveguide of FIG. 24*a*.

Illustrated in FIG. 24*a* is yet another acoustic waveguide of the invention which has paths of equal length, similarly to FIG. 23*a*. However, the paths of this waveguide in FIG. 24*a* have unequal exit areas. More particularly, the exit areas of the paths get progressively larger from the top of FIG. 24*a* to the bottom. Thus, the paths are symmetric with respect to only one plane, which is vertically oriented and extends into the page of FIG. 24*a*. The input side of the waveguide of FIG. 24*a* is shown in FIG. 24*b* and may be substantially identical to the input side of the waveguide shown in FIG. 23*b*.

Figure 25A:
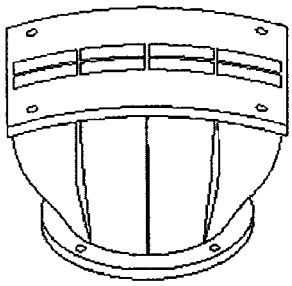
FIG. 25*a* is an output side view of an acoustic waveguide of the invention that may include the unequal acoustic paths shown in FIG. 22.
Figure 25B:
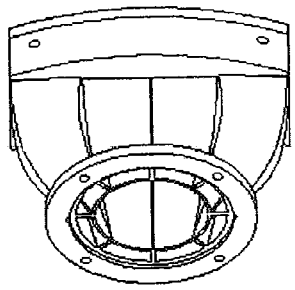
FIG. 25*b* is an input side view of the waveguide of FIG. 25*a*.

Illustrated in FIG. 25*a* is still another acoustic waveguide of the invention that may include acoustic paths of unequal lengths and but equal exit areas, as shown in FIG. 22. Thus, the paths are symmetric with respect to each of two planes that are perpendicular to each other. The input side of the waveguide of FIG. 25*a* is shown in FIG. 25*b*.

Figure 26A:
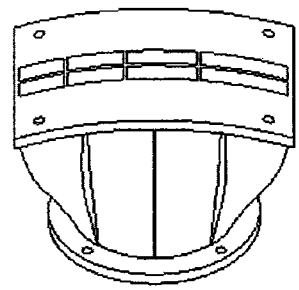
FIG. 26*a* is an output side view of another embodiment of a waveguide of the invention, similar to FIG. 25*a*, but with the acoustic paths having unequal exit areas.
Figure 26B:
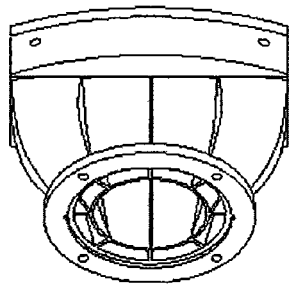
FIG. 26*b* is an input side view of the waveguide of FIG. 26*a*.

Illustrated in FIG. 26*a* is a further acoustic waveguide of the invention which has paths of unequal length, similarly to FIG. 25*a*. However, the paths of this waveguide in FIG. 26*a* also have unequal exit areas. More particularly, the exit areas of the paths get progressively larger from the top of FIG. 26*a* to the bottom. Thus, the paths are symmetric with respect to only one plane, which is vertically oriented and extends into the page of FIG. 26*a*. The input side of the waveguide of FIG. 26*a* is shown in FIG. 26*b* and may be substantially identical to the input side of the waveguide shown in FIG. 25*b*.

FIGS. 27-30 illustrate numerous additional variations of an acoustic waveguide of the invention. Specifically, FIG. 27*a* is an acoustic waveguide having a flat exit, equal path lengths L1-4, and unequal exit areas B1-4; FIG. 27*b* is an acoustic waveguide having a flat exit, unequal path lengths, and unequal exit areas; FIG. 28*a* is an acoustic waveguide having a complex curved exit, unequal path lengths, and equal exit areas; FIG. 28*b* is an acoustic waveguide having a complex curved exit, equal path lengths, and unequal exit areas; FIG. 28*c* is an acoustic waveguide having a complex curved exit, unequal path lengths, and unequal exit areas; FIG. 28*d* is an acoustic waveguide having a complex curved exit, equal path lengths, and equal exit areas. FIG. 29*a* is an acoustic waveguide having a concave exit, unequal path lengths, and equal exit areas; FIG. 29*b* is an acoustic waveguide having a concave exit, equal path lengths, and equal exit areas; FIG. 29*c* is an acoustic waveguide having a concave exit, unequal path lengths, and unequal exit areas; FIG. 29*d* is an acoustic waveguide having a concave exit, equal path lengths, and unequal exit areas; FIG. 30*a* is an acoustic waveguide having a convex exit, unequal path lengths, and equal exit areas; and FIG. 30*b* is an acoustic waveguide having a convex exit, equal path lengths, and unequal exit areas.

As can be seen in FIGS. 27-30 the walls defining the acoustic paths may be substantially S-shaped. That is, each wall may have two points of inflection. The intersection of the side walls and the inner and outer shells, as visible in FIGS. 27-30 may also be substantially S-shaped.

Figure 31:
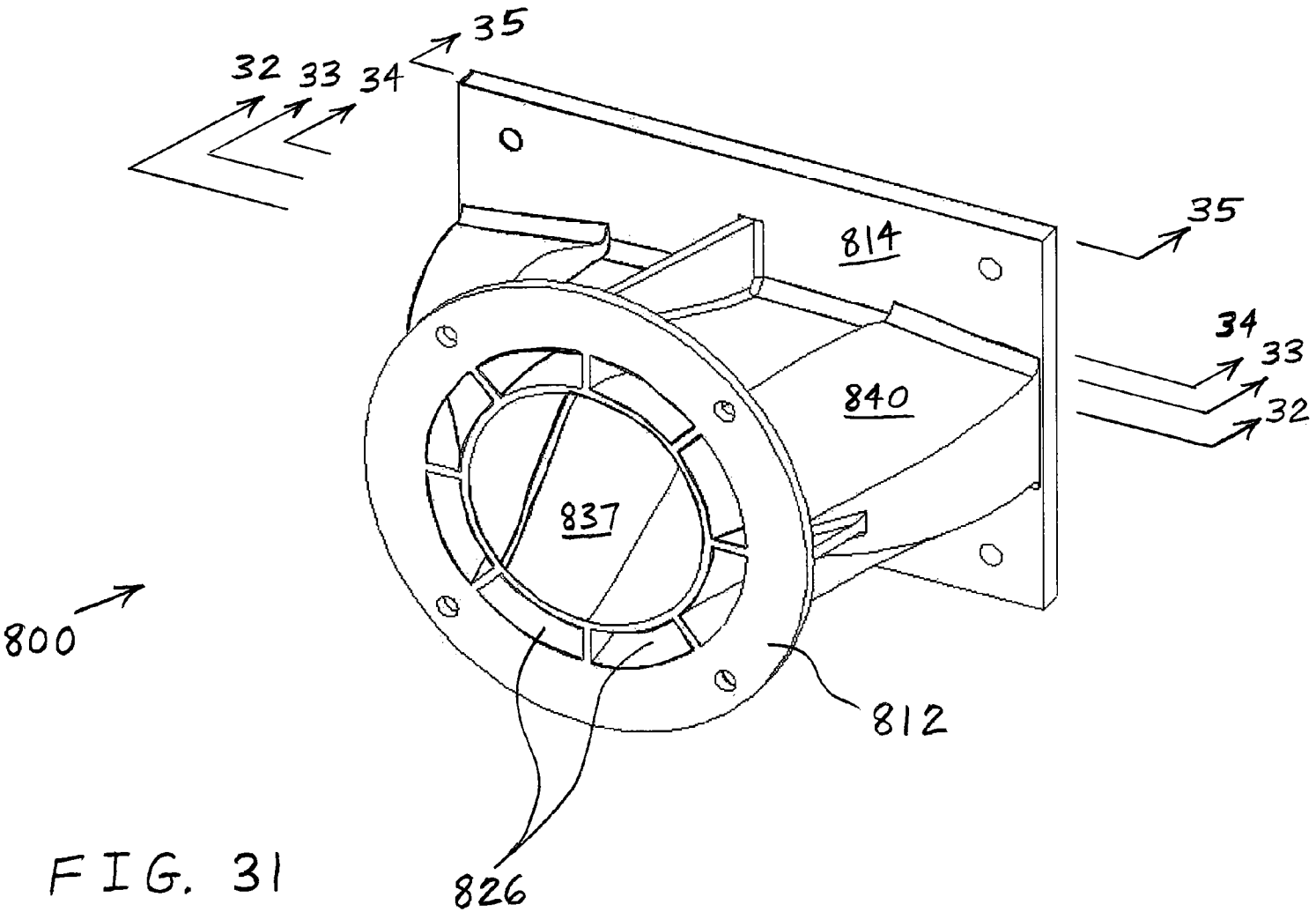
FIG. 31 is a perspective view of another embodiment of an acoustic waveguide of the present invention.
Figure 32:
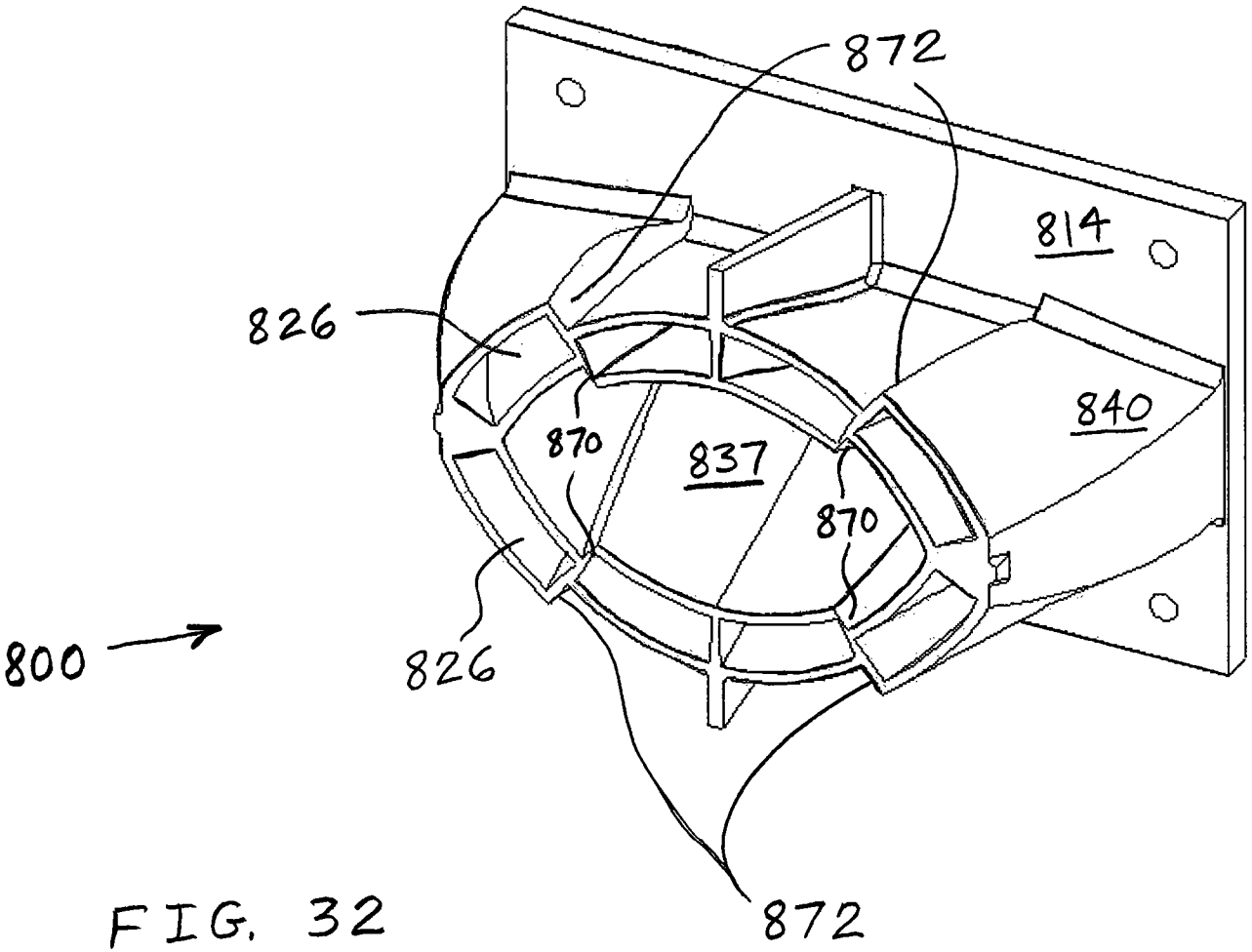
FIG. 32 is a perspective, cross-sectional view of the waveguide of FIG. 31 along line 32-32.
Figure 33:
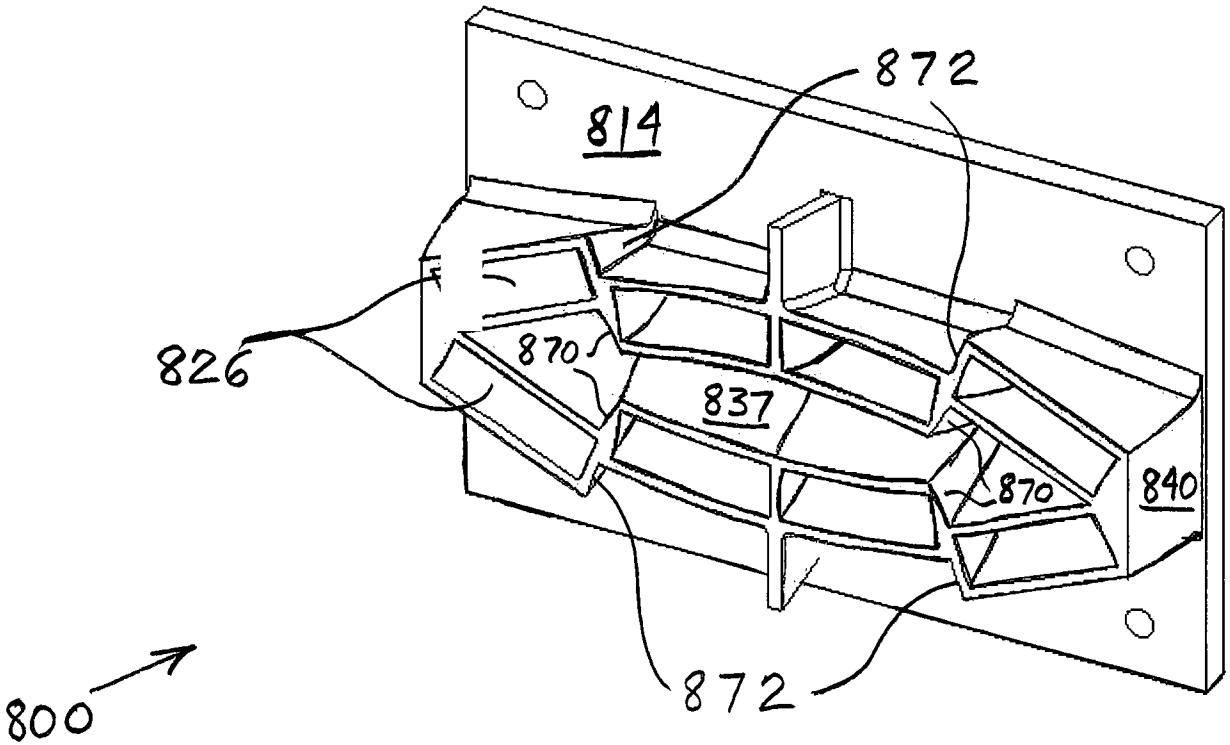
FIG. 33 is a perspective, cross-sectional view of the waveguide of FIG. 31 along line 33-33.

FIG. 31 illustrates another embodiment of an acoustic waveguide 800 of the present invention. As shown in FIG. 32, which is a cross-sectional view along line 32-32, a core 837, despite having an overall wedge shape, has discontinuities or "steps" 870 on both its inner and outer surfaces. An outer boundary wall 840 has corresponding steps 872 on both its inner and outer surfaces. Thus, the shapes and sizes of the acoustic paths 826 are substantially unaffected by steps 870, 872 and are similar to the acoustic paths in embodiments without such steps. The heights of steps 870, 872 are near a maximum in FIG. 33, which is a cross-sectional view along line 33-33.

Figure 34:
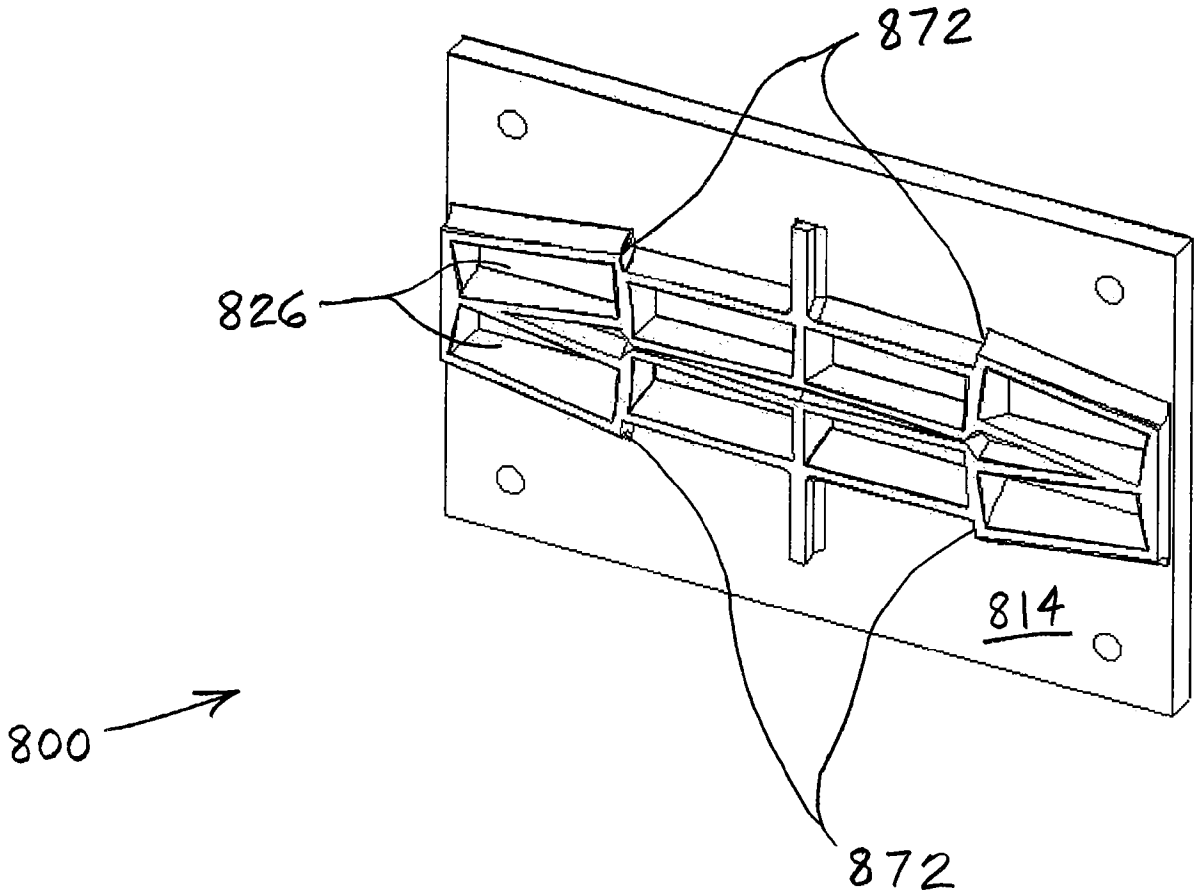
FIG. 34 is a perspective, cross-sectional view of the waveguide of FIG. 31 along line 34-34.
Figure 35:
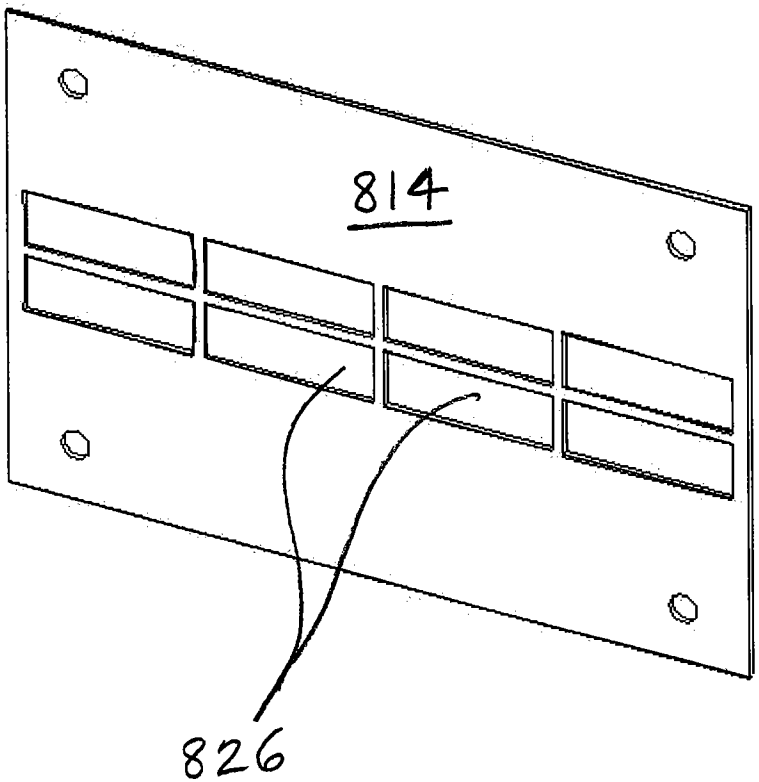
FIG. 35 is a perspective, cross-sectional view of the output plate of the waveguide of FIG. 31 along line 35-35.

As shown in FIG. 34, which is a cross-sectional view along line 34-34, the heights of steps 870, 872 decline near output plate 814. As further shown in FIG. 35, which is a cross-sectional view along line 35-35 through output plate 814, steps 870, 872 are eliminated at output plate 814, just as they are eliminated at input plate 812.

A limited number of embodiments of the waveguide of the invention have been illustrated and described herein. However, it is to be understood that the invention encompasses a myriad of source geometries which may be tailored to a variety of desired acoustic coverage patterns. Further, all of these variations in input and output geometries are realizable by virtue of the present invention.

A specific embodiment of the present invention may provide an acoustic wave guide including a substantially circular annular ring input at one end and a substantially rectangular output at the other end. There may exist four or more divided passages or paths which are symmetric in at least one plane. The passages may interconnect the input of the device to the output of the device for the purpose of transforming the shape of an acoustic wave from the input to the output. That is, the acoustic wave may be transformed to have a desired geometry and energy distribution.

The invention may encompasses varied combinations of elements including: a wave front of any shape at the exit; a flat exit with paths of equal lengths and equal areas; a flat exit with paths of unequal lengths, but equal areas; a flat exit with paths of unequal lengths and unequal areas; a flat exit with paths of equal lengths, but unequal areas; a convex curved exit with equal lengths and equal areas; a convex curved exit with paths of unequal lengths, but equal areas; a convex curved exit with paths of unequal lengths and unequal areas; a convex exit with paths of equal lengths, but unequal areas; a concave curved exit with paths of equal lengths and equal areas; a concave curved exit with paths of unequal lengths, but equal areas; a concave curved exit with paths of unequal lengths and unequal areas; a concave exit with paths of equal lengths, but unequal areas; a complex asymmetric curved exit with paths of equal lengths and equal areas; a complex asymmetric curved exit with paths of unequal lengths, but equal areas; a complex asymmetric curved exit with paths of unequal lengths and unequal areas; and/or a complex asymmetric exit with paths of equal lengths, but unequal areas.

As described herein, a first waveguide and a second waveguide (e.g., waveguides 10 and 110) may be coupled together in series. However, it is to be understood that the second waveguide does not necessarily need to receive input from a first waveguide. That is, the second waveguide may be operable within the scope of the invention with and without a first waveguide providing inputs for the second waveguide. The second waveguide may receive inputs from a source other than another waveguide.

While this invention has been described as having an exemplary design, the present invention may be further modified within the spirit and scope of this disclosure. This application is therefore intended to cover any variations, uses, or adaptations of the invention using its general principles.

What is claimed is:

1. An acoustic transformer, comprising:
at least one outer boundary wall; and
a plurality of inner walls disposed within the outer boundary wall, the outer boundary wall and the inner walls defining:
an input opening divided by at least some of the inner walls into a plurality of input sections;
a substantially annular output opening divided by at least some of the inner walls into a plurality of circumferentially-spaced output sections, each of the output sections having an inner circumferential side and an outer circumferential side; and
a plurality of acoustic paths, each of the paths interconnecting a respective one of the input sections with a respective one of the output sections, each of the paths having a substantially equal path length and a substantially equal expansion rate.

2. The transformer of claim 1 further comprising a substantially circular input plate surrounding the input opening, the input plate having a substantially flat surface opposite the outer boundary wall, the flat surface being configured to interface with a loudspeaker.

3. The transformer of claim 1 further comprising a substantially annular output plate surrounding the output opening, the output plate having a substantially flat surface opposite the outer boundary wall.

4. The transformer of claim 1 wherein the plurality of inner walls include a cone-shaped core.

5. The transformer of claim 1 wherein the input opening is circular and each of the input sections is pie-shaped.

6. The transformer of claim 1 wherein the inner walls include a plurality of triangular walls, each of the acoustic paths being partially defined by a respective one of the triangular walls.

7. An acoustic transformer, comprising:
at least one outer boundary wall; and
a plurality of inner walls disposed within the outer boundary wall, the outer boundary wall and the inner walls defining:
a circular input opening divided by at least some of the inner walls into a plurality of pie-shaped input sections;
a substantially annular output opening divided by at least some of the inner walls into a plurality of circumferentially-spaced output sections; and
a plurality of air-filled acoustic paths, each of the paths interconnecting a respective one of the input sections with a respective one of the output sections, each of the paths being separated in an air-tight manner from each of the other paths.

8. The transformer of claim 7 wherein each of the paths has a substantially equal path length, and each of the paths has a substantially equal expansion rate such that each of the paths has a substantially equal acoustic impedance from the input opening to the output opening.

9. The transformer of claim 7 wherein each of the output sections has an inner circumferential side and an outer circumferential side.

10. The transformer of claim 7 further comprising a circular input plate surrounding the circular input opening, the circular input plate being attached to an edge of the outer boundary wall.

11. The transformer of claim 7 wherein the outer boundary wall is substantially frusto-conically-shaped.

12. The transformer of claim 7 wherein the inner walls include a cone-shaped core, the outer boundary wall being in spaced relationship with an outer surface of the cone-shaped core.

13. An acoustic transformer, comprising:

a substantially cone-shaped core;

a frusto-conically-shaped outer boundary wall in spaced relationship with an outer surface of the cone-shaped core; and a plurality of inner walls disposed between and interconnecting the cone-shaped core and the outer boundary wall, the inner walls dividing a space between the cone-shaped core and the outer boundary wall into a plurality of acoustic paths, each of the paths having a substantially equal length and a substantially equal expansion rate.

14. The transformer of claim 13 wherein the outer boundary wall and the cone-shaped core define between them a circular input opening divided by the inner walls into a plurality of pie-shaped sections.

15. The transformer of claim 14 further comprising a substantially circular input plate surrounding the input opening, the input plate having a substantially flat surface opposite the outer boundary wall, the flat surface being configured to interface with a loudspeaker.

16. The transformer of claim 13 wherein the outer boundary wall and the cone-shaped core define between them a substantially annular output opening divided by the inner walls into a plurality of circumferentially-spaced output sections.

17. The transformer of claim 13 wherein the outer boundary wall and the cone-shaped core define between them a circular input opening divided by the inner walls into a plurality of pie-shaped sections, the outer boundary wall and the cone-shaped core defining between them a substantially annular output opening divided by the inner walls into a plurality of circumferentially-spaced output sections, each of the paths interconnecting a respective one of the input sections with a respective one of the output sections.

18. An acoustic waveguide comprising first and second opposite ends, the first end including a substantially circular input, the second end including a substantially annular ring output, a group of at least four divided passages interconnecting the input and the output, the group of passages being symmetric relative to at least one plane.

19. The waveguide of claim 18, wherein the group of passages is symmetric relative to each of two planes, the two planes being perpendicular to each other.

20. The transformer of claim 1 wherein the inner circumferential side of each of the output sections is arcuate and the outer circumferential side of each of the output sections is arcuate.

21. The transformer of claim 1 wherein each of the inner walls is arcuate in a circumferential direction that is substantially perpendicular to an associated one of the acoustic paths.

22. The transformer of claim 1 wherein the outer boundary wall is arcuate in circumferential directions substantially perpendicular to associated ones of the acoustic paths.

* * * * *